US008983320B2

(12) United States Patent
Suzuki et al.

(10) Patent No.: US 8,983,320 B2
(45) Date of Patent: Mar. 17, 2015

(54) IMAGE FORMING APPARATUS

(71) Applicants: Shingo Suzuki, Kanagawa (JP); Satoshi Kaneko, Kanagawa (JP); Tetsuya Muto, Kanagawa (JP); Shuji Hirai, Tokyo (JP); Shinichi Akatsu, Kanagawa (JP); Keita Gotoh, Kanagawa (JP); Yuuichiroh Uematsu, Kanagawa (JP)

(72) Inventors: Shingo Suzuki, Kanagawa (JP); Satoshi Kaneko, Kanagawa (JP); Tetsuya Muto, Kanagawa (JP); Shuji Hirai, Tokyo (JP); Shinichi Akatsu, Kanagawa (JP); Keita Gotoh, Kanagawa (JP); Yuuichiroh Uematsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/203,798

(22) Filed: Mar. 11, 2014

(65) Prior Publication Data

US 2014/0270828 A1 Sep. 18, 2014

(30) Foreign Application Priority Data

Mar. 15, 2013 (JP) ..... 2013-053457

(51) Int. Cl.
*G03G 15/06* (2006.01)
*G03G 15/00* (2006.01)

(52) U.S. Cl.
CPC ..... *G03G 15/065* (2013.01); *G03G 15/5058* (2013.01); *G03G 2215/0129* (2013.01); *G03G 2215/0164* (2013.01)
USPC ..... 399/55; 399/53; 399/50

(58) Field of Classification Search
None
See application file for complete search history.

(56) References Cited

U.S. PATENT DOCUMENTS

| | | | | |
|---|---|---|---|---|
| 2005/0063721 | A1* | 3/2005 | Nakayama et al. | 399/49 |
| 2007/0025748 | A1 | 2/2007 | Ishibashi et al. | |
| 2012/0201552 | A1 | 8/2012 | Hirai et al. | |
| 2013/0108288 | A1 | 5/2013 | Kaneko et al. | |
| 2013/0108292 | A1 | 5/2013 | Suzuki et al. | |
| 2013/0243456 | A1 | 9/2013 | Kaneko et al. | |
| 2013/0243457 | A1 | 9/2013 | Kaneko et al. | |

FOREIGN PATENT DOCUMENTS

| | | |
|---|---|---|
| JP | 6-110285 | 4/1994 |
| JP | 9-062042 | 3/1997 |
| JP | 2000-098675 | 4/2000 |
| JP | 2007-033770 | 2/2007 |
| JP | 2007-140402 | 6/2007 |

* cited by examiner

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

An image forming apparatus includes a latent-image bearing body, a charging unit, a latent-image writing unit, a development unit, a development power, and a bias control unit. After a start of an image forming operation, the bias control unit performs a process of constantly maintaining an output of a development bias at an adjustment bias value. The adjustment bias value is a central value in a periodic fluctuation range of the output of the development bias. At a timing at which a difference of the development bias from the adjustment bias value in the periodic fluctuation range is less than or equal to a predetermined threshold value, the bias control unit performs switching from the process of constantly maintaining the output of the development bias at the adjustment bias value to a process of periodically changing the output of the development bias based on development bias control data.

20 Claims, 24 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2013-053457, filed on Mar. 15, 2013, in the Japan Patent Office, the entire disclosure of which is hereby incorporated by reference herein.

BACKGROUND

1. Technical Field

Embodiments of this disclosure relate to an image forming apparatus which periodically changes an output of a development bias to be supplied to a development unit or an output of a charging bias to be supplied to a charging unit which uniformly charges a latent-image bearing body to be rotationally driven.

2. Description of the Related Art

Image forming apparatuses are used as, for example, copiers, printers, facsimile machines, printing presses, and multifunctional devices having at least one of the foregoing capabilities. As one type of image forming apparatus, for example, an image forming apparatus disclosed in JP-H09-062042-A is known. This image forming apparatus includes a drum-shaped photoconductor serving as a latent-image bearing body and a development device provided with a development sleeve serving as a developer bearing body opposing the photoconductor at a predetermined clearance. Then, according to an electrophotographic process, a toner image is obtained by developing an electrostatic latent image formed on a surface of the rotationally driven photoconductor using a developer held on the surface of the rotationally driven development sleeve.

In this configuration, when the development sleeve has low roundness or is eccentric, a clearance (hereinafter referred to as a development gap) between the photoconductor and the development sleeve periodically fluctuates according to rotation of the development sleeve, and accordingly the strength of an electric field formed on the development gap fluctuates. Then, according to the fluctuation in the strength of this electric field, periodic image density unevenness occurs which increases/decreases an image density in the same cycle as the rotation cycle of the development sleeve.

Accordingly, the image forming apparatus disclosed in JP-H09-062042-A pre-stores a correction table for a development bias constructed based on a result obtained by inspecting a relationship between a rotation angular position of the development sleeve and a pattern of periodic image density unevenness. Then, while the rotation angular position of the development sleeve is detected, a correction amount of the development bias corresponding to the rotation angular position is specified and an output of the development bias is corrected based on a specification result. Thereby, it is possible to suppress the strength fluctuation of the electric field formed in the development gap and suppress the occurrence of periodic image density unevenness by periodically changing the development bias while following periodic fluctuation of the development gap.

BRIEF SUMMARY

In at least one embodiment of this disclosure, there is provided an image forming apparatus including a latent-image bearing body, a charging unit, a latent-image writing unit, a development unit, a development power, and a bias control unit. The latent-image bearing body is rotationally driven. The charging unit uniformly charges a surface of the latent-image bearing body. The latent-image writing unit writes a latent image to the surface after the charging unit uniformly charges the surface. The development unit develops the latent image to form a toner image. The development power source outputs a development bias to be supplied to the development unit. The bias control unit performs a process of periodically changing an output of the development bias from the development power source based on development bias control data. After a start of an image forming operation, the bias control unit performs a process of constantly maintaining the output of the development bias at an adjustment bias value for imaging with a pre-adjusted and fixed bias value, the adjustment bias value being a central value in a periodic fluctuation range of the output of the development bias. At a timing at which a difference of the development bias from the adjustment bias value in the periodic fluctuation range is less than or equal to a predetermined threshold value, the bias control unit performs switching from the process of constantly maintaining the output of the development bias at the adjustment bias value to the process of periodically changing the output of the development bias based on the development bias control data.

In at least one exemplary embodiment of this disclosure, there is provided an image forming apparatus including a latent-image bearing body, a charging unit, a latent-image writing unit, a development unit, a charging power source, and a bias control unit. The latent-image bearing body is rotationally driven. The charging unit uniformly charges a surface of the latent-image bearing body. The latent-image writing unit writes a latent image to the surface after the charging unit uniformly charges the surface. The development unit develops the latent image to form a toner image. The charging power source outputs a charging bias to be supplied to the charging unit. The bias control unit performs a process of periodically changing an output of the charging bias from the charging power source based on charging-bias control data. After a start of an image forming operation, the bias control unit performs a process of constantly maintaining the output of the charging bias at an adjustment bias value for imaging with a pre-adjusted and fixed bias value, the adjustment bias value being a central value in a periodic fluctuation range of the output of the charging bias. At a timing at which a difference of the charging bias from the adjustment bias value in the periodic fluctuation range is less than or equal to a predetermined threshold value, the bias control unit performs switching from the process of constantly maintaining the output of the charging bias at the adjustment bias value to the process of periodically changing the output of the charging bias based on the charging-bias control data.

BRIEF DESCRIPTION OF THE DRAWINGS

The aforementioned and other aspects, features, and advantages of the present disclosure would be better understood by reference to the following detailed description when considered in connection with the accompanying drawings, wherein.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

For an image forming apparatus like that disclosed in JP-H09-062042-A, when a development bias is periodically varied from a fixed value based on a specified correction amount at the initiation of an image forming operation, there is a possibility of background staining or carrier adherence. The background staining is a phenomenon in which toner of the developer containing the toner and carrier held on a surface of a development sleeve is reversely transferred to a background area (which becomes a non-image area in a uniformly charged area) of a photoconductor serving as a latent-image bearing body. In addition, although carrier adherence includes carrier adherence occurring in an image area of the photoconductor and carrier adherence occurring in the background area, there is a possibility of the latter carrier adherence occurring in the image forming apparatus.

The causes of the background staining or the carrier adherence in the image forming apparatus will be described in detail. In order to suppress the background staining in a general image forming apparatus as well as a configuration in which the development bias is periodically changed as in the above-described image forming apparatus, the development bias is applied to the development sleeve substantially simultaneously with the initiation of rotation of the development sleeve. The electric field of a direction in which the toner between the background area of the photoconductor and the development sleeve is pressed toward the photoconductor side is formed by applying the development bias simultaneously with the rotation of the development sleeve, and therefore the occurrence of the background staining is suppressed. Even in the image forming apparatus disclosed in JP-H09-062042-A, the application of the development bias to the development sleeve is considered to start substantially simultaneously when the rotation of the development sleeve starts.

Figure 32:
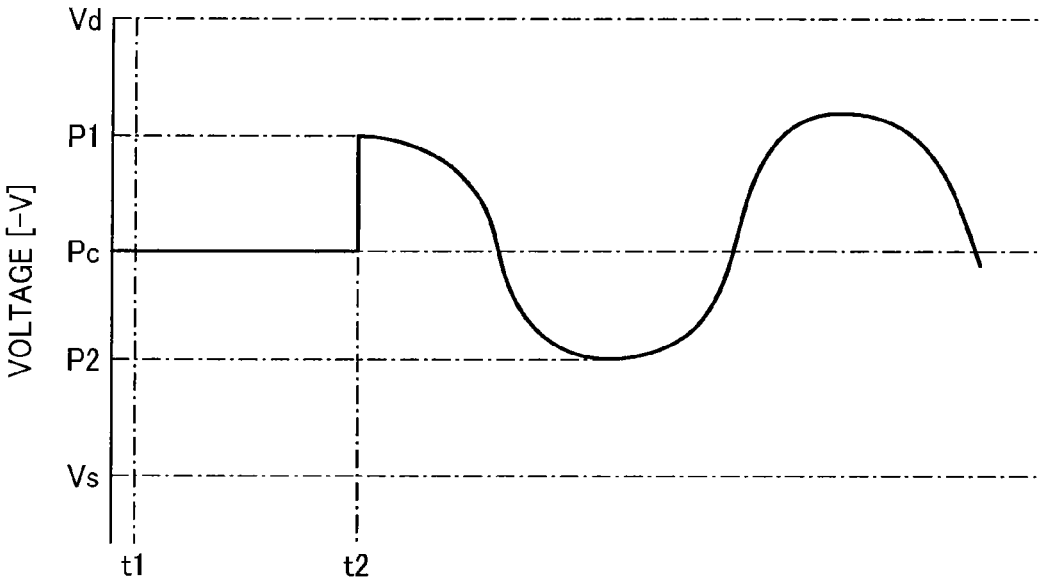
FIG. 32 is a waveform of a first example of time-dependent fluctuation of a development bias.

FIG. 32 is a waveform of a first example when the development bias is periodically varied based on a specified correction amount. In FIG. 32, Vd represents a background area potential of the photoconductor. In addition, Vs represents a latent-image potential of the photoconductor. In addition, a graph represented by a solid line in the drawing represents a profile obtained by periodically varying the development bias based on a specified correction amount. Here, an example as a sinusoidal wave is simply illustrated for description. In FIG. 32, a timing of t1 of the drawing is a rotation start timing of the development sleeve, and the application of the development bias to the development sleeve starts at this timing. At this start, as the development bias, a development bias including a direct current (DC) bias of a fixed value is applied as illustrated. In the image forming apparatus disclosed in JP-H09-062042-A, the development bias including the DC bias of the fixed value is considered to be applied as the development bias at the initiation of the application. This is for the following reason. That is, until a sleeve rotation speed increases to be stable at a fixed speed at the initiation of the rotation of the development sleeve, the rotation cycle of the development sleeve is longer than usual. Thus, when the development bias is changed in synchronization with a sleeve rotation cycle, it is necessary to wait until the rotation speed of the development sleeve stabilizes. Consequently, even in the image forming apparatus disclosed in JP-H09-062042-A, the development bias of the fixed value is considered to be applied at the initiation of the application.

When the timing (t2 in the drawing) at which the rotation speed of the development sleeve stabilizes is reached after the application of the development bias has been initiated, the development sleeve is switched from a development bias having a fixed value to a development bias which fluctuates in a rotation cycle of the development sleeve. At this time, when the development sleeve incidentally reaches a rotation angular position at which the development gap is maximized, a maximum value P1 of an upper peak side is applied to the development sleeve in a fluctuation range of one cycle in the development bias as illustrated. Then, at this time, a development potential becomes a maximum value during one cycle. For example, it is assumed that the background area potential Vd is −750 [V] and the development bias fluctuates in a range from −300 [V] which is a minimum value P2 of a lower peak side to −500 [V] which is the maximum value P1 of the upper peak side, and a latent-image potential Vs is −50 [V]. In this case, when the development bias becomes −500 [V] which is the maximum value P1 of the upper peak side, the development potential which is a potential difference between the development bias and the latent-image potential Vs becomes a maximum of 450 [V] during one cycle. Thereby, even when the development gap is maximized, it is possible to cause an electric field with a strength close to a target to act on toner without causing insufficient strength of the electric field. On the other hand, because a background potential which is a potential difference between the development bias and the background area potential Vd becomes a minimum of 250 [V] during one cycle, the background staining easily occurs. When the development bias is periodically changed according to the rotation cycle, the background staining rarely occurs even at the timing of the maximum value P1 of the upper peak side because the development bias is slowly varied across about ¼ cycle from a fixed value Pc of correction amount zero to the maximum value P1. However, when the development bias is varied at once from the fixed value Pc of correction amount zero to the maximum value P1 of the upper peak side as illustrated, a reaction force is assigned to toner by decreasing the background potential at once and the background staining easily occurs. Thus, in the illustrated example, the background staining easily occurs at the timing of t2.

Figure 33:
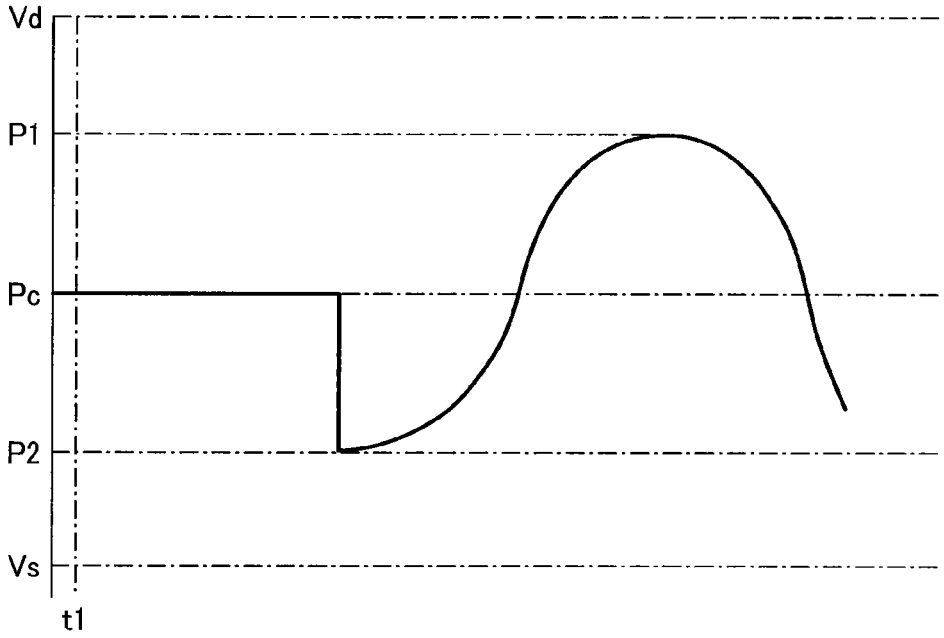
FIG. 33 is a waveform of a second example of the time-dependent fluctuation of the development bias.

FIG. 33 is a waveform of a second example when the development bias is periodically varied based on a specified correction amount. This second example is an example in which the development sleeve incidentally reaches a rotation angular position at which the development gap is minimized at a timing (t2 in the drawing) at which the rotation speed of the development sleeve has stabilized. In this case, as illustrated, the development bias of the minimum value P2 of the lower peak side in a fluctuation range of the development bias is applied to the development sleeve at the timing of t2. At this time, because the development potential becomes 250 [V] which is a minimum value during one cycle, it is possible to cause the electric field of the strength close to the target to act on the toner even when the development gap is minimized. On the other hand, the background potential becomes a maximum of 450 [V] during one cycle. Then, the toner is strongly pressed toward the development sleeve and the carrier is peeled, so that carrier adherence is easily caused. That is, when the development bias is varied at once from the fixed value Pc of correction amount zero to the minimum value P2 of the lower peak side as illustrated, a reaction force is assigned to the carrier by increasing the background potential at once and the carrier adherence is easily caused. Thus, in the illustrated example, the carrier adherence easily occurs at the timing of t2.

Also, an output of the development bias is configured to fluctuate in a waveform for one cycle per rotation cycle of the development sleeve with regard only to image density fluctuation caused by the fluctuation of the development gap due to eccentricity of the development sleeve in FIG. 32 or 33. However, in the fluctuation of the development gap, a higher-order periodic fluctuation component which fluctuates in ½ cycle, ⅓ cycle, . . . , 1/n cycle for one rotation cycle of the sleeve is normally included in addition to a fluctuation component drawing a waveform of one cycle in one rotation cycle of the development sleeve as in these drawings. When the image density fluctuation due to these periodic fluctuation components is also suppressed, a fluctuation pattern of the output of the development bias corresponding to the image density fluctuation in which the fluctuation components are superimposed becomes a complex waveform without becoming a clear sine wave.

In addition, there is periodic fluctuation due to a roundness error or eccentricity of the photoconductor in addition to periodic fluctuation due to a roundness error or eccentricity of the development sleeve as the periodic fluctuation of the development gap. The image density fluctuation due to the roundness error or eccentricity of the photoconductor includes a fluctuation component which fluctuates in one cycle for one rotation cycle of the photoconductor. Further, a higher-order periodic fluctuation component which fluctuates in ½ cycle, ⅓ cycle, . . . , 1/n cycle may be included in addition to a fluctuation component of one cycle. By changing the output of the development bias in a predetermined periodic fluctuation pattern pre-constructed based on experiments while detecting the rotation angular position of the photoconductor even in these image density fluctuations, it is possible to suppress the occurrence thereof. Further, the periodic fluctuation of the development bias based on a result obtained by detecting the rotation angular position of the development sleeve and the periodic fluctuation of the development bias based on a result obtained by detecting the rotation angular position of the photoconductor may be superimposed. In any case, when switching to a process of periodically changing the output of the charging bias from the fixed value of correction amount zero is performed at the start-up of the apparatus as in the image forming apparatus disclosed in JP H09-062042, the background staining or the carrier adherence is easily caused.

In addition, it is also possible to suppress the periodic image density unevenness caused by the fluctuation of the development gap due to the eccentricity, etc. of the development sleeve or the photoconductor by periodically changing the charging bias in place of or in addition to periodically changing the development bias. Even in this configuration, the background staining or the carrier adherence is easily caused when switching to a process of periodically changing the output of the development bias from the fixed value of correction amount zero is performed at the start-up of the apparatus.

In light of the above-described situation, at least one embodiment of the present disclosure provides an image forming apparatus can suppress occurrence of background staining or carrier adherence in switching a bias from a constant value to a periodically changing value while suppressing occurrences of uneven image density due to a periodic fluctuation of a development gap.

As described below, in an image forming apparatus according to at least one embodiment of this disclosure, by periodically changing development bias or charging bias, an electric field having a substantially constant strength is acted on toner of a developing device regardless of fluctuation of a development gap. Such a configuration can suppress occurrence of uneven image density due to the fluctuation of the development gap.

When the output of the development bias or the charging bias is switched from a fixed value (adjustment bias value) to a periodically changing value, the periodically changing output of the development bias or the charging bias is set to have the following initial value. That is, in a range of periodical change, the initial value is set to be a value at which a difference from the fixed value is less than or equal to a predetermined threshold value. As a result, in switching from a process of maintaining the development bias or the charging bias at the fixed value to a process of periodically changing the development bias or the charging bias, the potential difference of the development bias or the charging bias between before and after the switching can be substantially canceled, thus suppressing occurrence of background staining or carrier adherence.

Referring now to the drawings, embodiments of the present disclosure are described below. In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In the drawings for explaining the following embodiments, the same reference codes are allocated to elements (members or components) having the same function or shape and redundant descriptions thereof are omitted below.

Hereinafter, an example of a so-called tandem-type full-color electrophotographic copier (hereinafter simply referred to as a "copier") in which a plurality of photoconductors are provided will be described as an image forming apparatus according to an embodiment of this disclosure.

First, a basic configuration of the copier according to this embodiment will be described.

Figure 1:
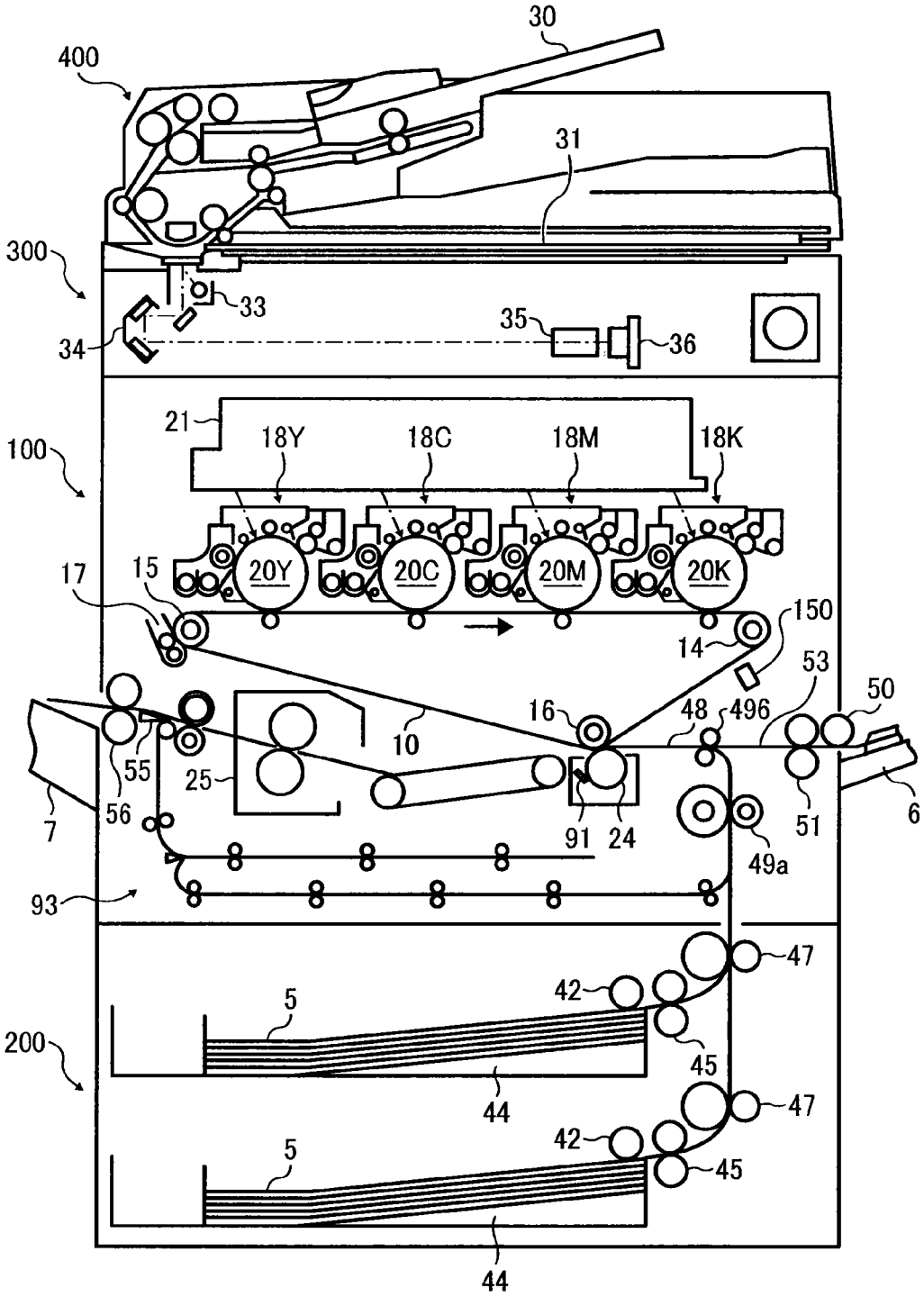
FIG. 1 is a schematic view of a configuration of a copier serving as an image forming apparatus according to an embodiment of this disclosure.

FIG. 1 is a schematic view of a configuration of the copier serving as the image forming apparatus according to this embodiment. In FIG. 1, the copier includes a print section 100 configured to perform image formation, a sheet feeder 200 configured to supply a recording sheet 5, which is a recording member, to the print section 100, a scanner 300 configured to read a document image mounted on the print section 100, etc. In addition, the copier further includes an auto-document feeder (ADF) 400, etc. mounted at the top of the scanner 300. In the print section 100, a bypass tray 6 for bypassing and feeding the recording sheet 5 and a discharge tray 7 from which the image-formed recording sheet 5 is discharged are provided.

Figure 2:
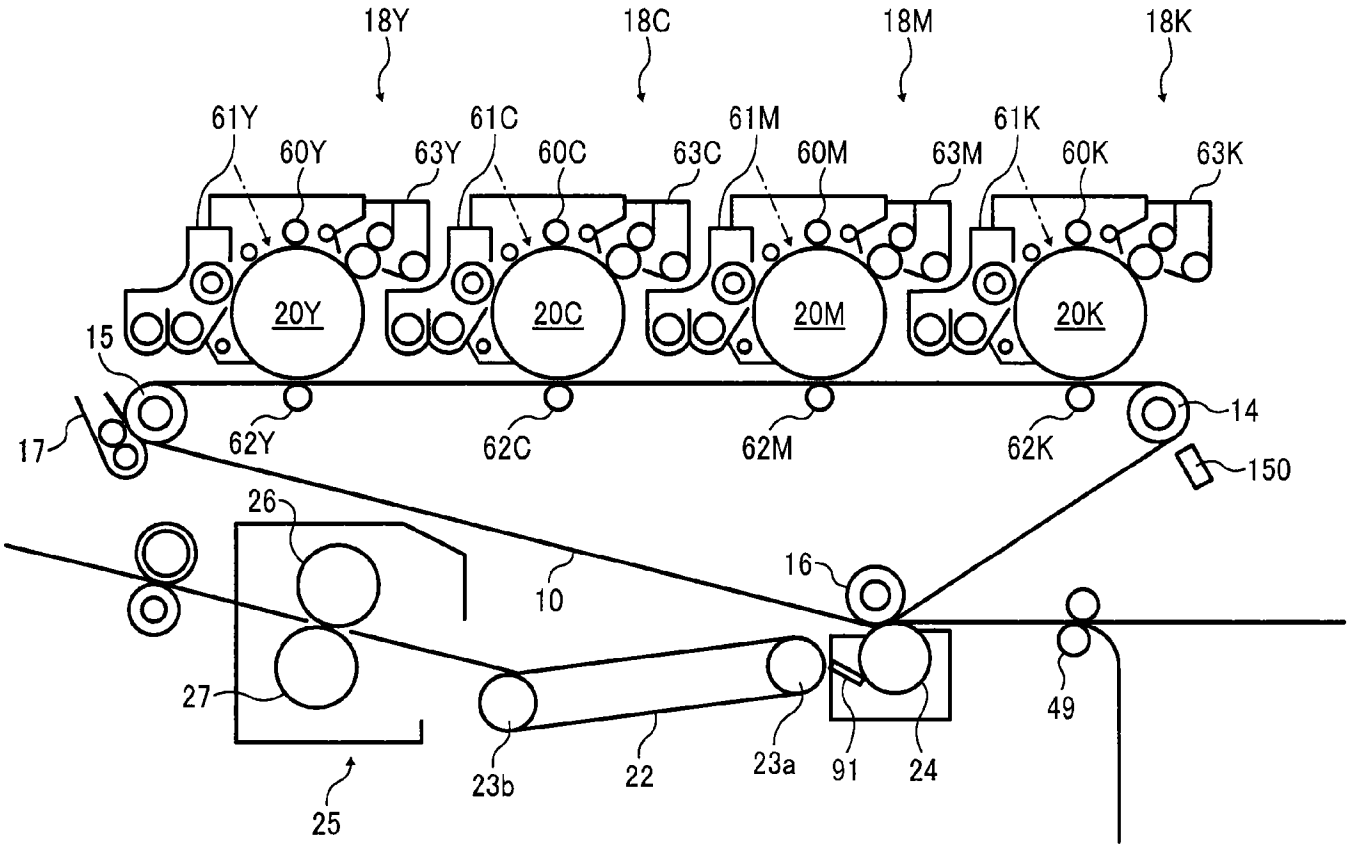
FIG. 2 is an enlarged view of a configuration of a print section of the copier.

FIG. 2 is an enlarged view of a configuration of the print section 100. In the print section 100, an endless intermediate transfer belt 10 serving as a transfer body is provided. In a state in which the intermediate transfer belt 10 has extended to support rollers 14, 15, and 16, the intermediate transfer belt 10 is endlessly moved in a clockwise direction in the drawing according to rotational driving of any one of the support rollers. On a belt extending portion between the first support roller 14 and the second support roller 15 among the support rollers 14, 15, and 16, four imaging units 18Y, 18C, 18M, and 18K of yellow (Y), cyan (C), magenta (M), and black (K) are disposed side by side. In addition, an optical sensor unit 150 for detecting an image density (adherence amount of toner per unit area) of the solid toner image formed on the intermediate transfer belt 10 is attached to the belt extending portion between the second support roller 15 and the third support roller 16.

In FIG. 1, a laser writing device 21 is provided above the imaging units 18Y, 18C, 18M, and 18K. This laser writing device 21 emits writing light by driving a semiconductor laser according to a laser controller based on image information of a document read by the scanner 300. Then, electrostatic latent images are formed on photoconductors by exposing and scanning drum-shaped photoconductors 20Y, 20C, 20M, and 20K serving as latent-image bearing bodies provided in the imaging units 18Y, 18C, 18M, and 18K according to the writing light. Also, a light source of the writing light is not limited to a laser diode, and, for example, may be a light-emitting diode (LED).

Figure 3:
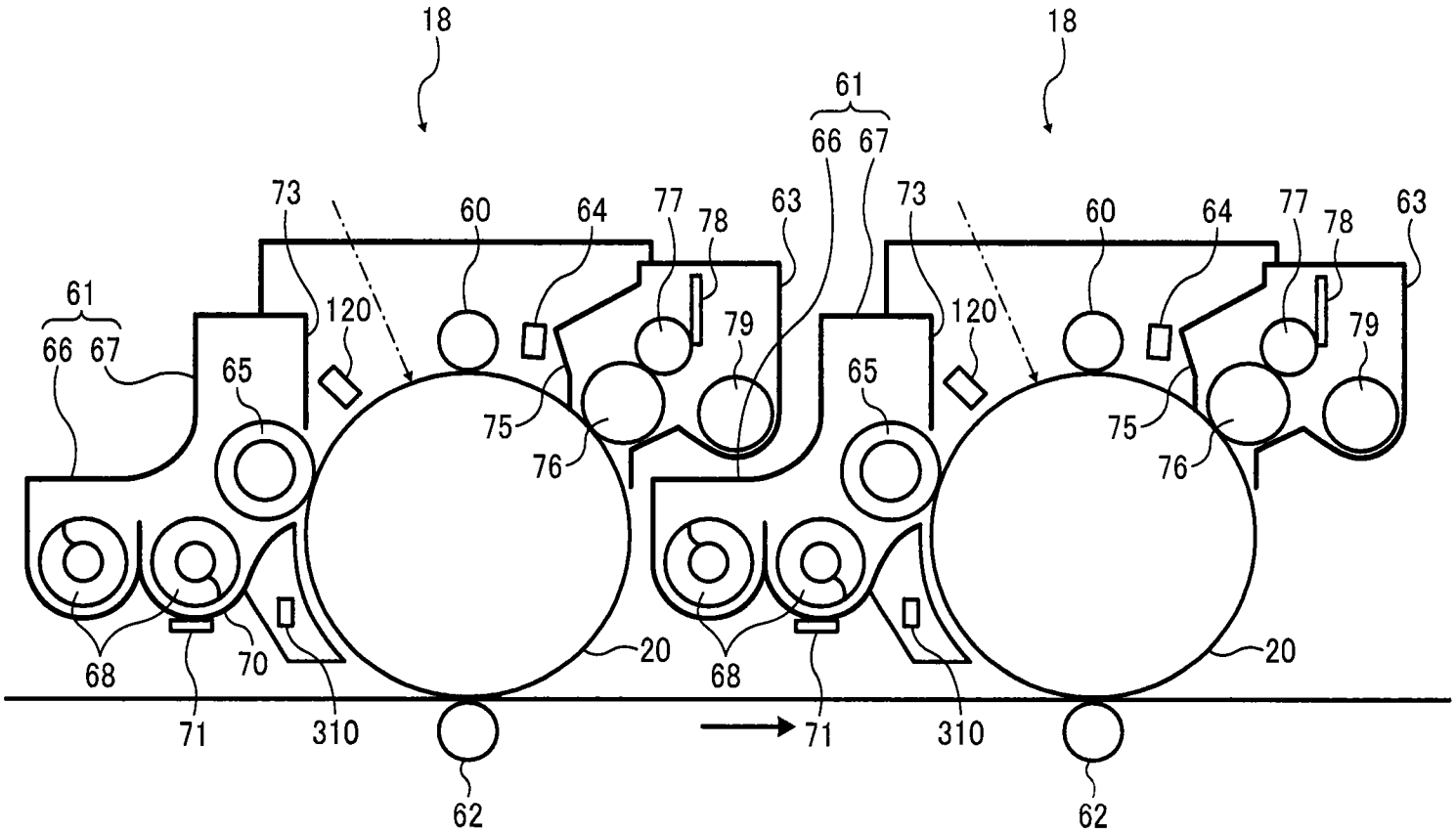
FIG. 3 is an enlarged view of a configuration of two of four imaging units in the print section.

FIG. 3 is an enlarged view of a configuration of two of the four imaging units 18Y, 18C, 18M, and 18K. Also, because the four imaging units 18Y, 18C, 18M, and 18K have substantially the same configuration except that colors to be used are different from each other, suffixes such as Y, C, M, and K attached to reference numerals of the members are omitted in FIG. 3. In addition, these suffixes are also appropriately omitted in the following description as necessary.

In the imaging unit 18, a charging device 60, a development device 61, a photoconductor cleaning device 63, and a neutralization device 64 are provided around the photoconductor 20. In addition, a primary transfer device 62 is provided at a position at which the primary transfer device 62 opposes the photoconductor 20 with the intermediate transfer belt 10 interposed therebetween.

The charging device 60 is a charging device of a contact charging system adopting a charging roller, and uniformly charges a surface of the photoconductor 20 by applying a voltage in contact with the photoconductor 20. In this charging device 60, it is possible to adopt a charging device of a non-contact charging system adopting a non-contact scorotron charger or the like.

In the development device 61, a two-component developer including magnetic carrier and non-magnetic toner is used. Also, a one-component developer may be used as the developer. This development device 61 can be classified roughly into an agitation section 66 and a development section 67 provided within a development housing 70. The two-component developer (hereinafter simply referred to as a developer)

is transported while being agitated in the agitation section 66 and supplied onto a development sleeve 65 to be described later as the developer bearing body. The agitation section 66 is provided with two parallel screws 68 and a partition plate for partitioning so that both ends of opposed ends are in communication with each other is provided between the two screws 68. In addition, a toner-density sensor 71 for detecting a toner density of the developer within the development device 61 is attached to the development housing 70.

On the other hand, the development sleeve 65 which is rotationally driven while part of a circumferential surface of the development section 67 opposes the photoconductor 20 at a predetermined clearance through an opening of the development housing 70 is arranged in the development section 67. Within the development sleeve 65, a magnet roller is fixedly arranged not to rotate together with the development sleeve 65. In addition, a doctor blade 73 has a protruding edge which is close to the surface of the development sleeve 65.

Within the development device 61, the developer is transported and circulated while being agitated by the two screws 68 and supplied to the development sleeve 65. The developer supplied to the development sleeve 65 is pumped up to the sleeve surface according to a magnetic force generated by a magnet roller arranged within the development sleeve 65. The developer pumped up to the development sleeve 65 is transported according to rotation of the development sleeve 65, and regulated to an appropriate amount by the doctor blade 73. Also, the regulated developer returns to the agitation section 66.

The developer transported by the development sleeve 65 to a development area at which the developer opposes the photoconductor 20 is in a napping state according to the magnetic force generated by the magnet roller and forms a magnetic brush. In the development area, a development electric field is formed to move the toner within the developer to an electrostatic latent-image area on the photoconductor 20 according to a development bias applied to the development sleeve 65. Thereby, the toner within the developer is transitioned to the electrostatic latent-image area on the photoconductor 20 and develops the electrostatic latent image.

The developer passing through the development area is transported to a portion in which the magnetic force of the magnetic roller is weak and therefore is separated from the development sleeve 65 and returned to the agitation section 66. When the toner density within the agitation section 66 becomes thin by repeating such an operation, the toner-density sensor 71 detects the toner density. Based on a detection result, the toner is supplied to the agitation section 66.

The primary transfer roller is adopted as the primary transfer device 62, and is installed to be pressed against the photoconductor 20 with the intermediate transfer belt 10 sandwiched therebetween. As the primary transfer device 62, a primary transfer device of a conductive brush shape, a primary transfer device of a non-contact corona charger, or the like may be adopted instead of a primary transfer device of a roller shape.

The photoconductor cleaning device 63 is provided with a cleaning blade 75 disposed so that a protruding edge is pressed against the photoconductor 20. In addition, a conductive fur brush 76 is also provided in contact with the photoconductor 20. The toner removed by the cleaning blade 75 or the fur brush 76 from the photoconductor 20 is housed within the photoconductor cleaning device 63.

The neutralization device 64 including a neutralization lamp, etc. initializes a surface potential of the photoconductor 20 which is irradiated with light. The potential sensor 120 opposing the photoconductor 20 is provided on the imaging unit 18. The potential sensor 120 is provided to oppose the photoconductor 20 and detects a surface potential of the photoconductor 20.

The surface of the photoconductor 20, for example, is uniformly charged by the charging device 60 to −700 [V], and the potential of the electrostatic latent-image area irradiated with the laser light by the laser writing device 21, for example, becomes −150 [V]. On the other hand, the development bias, for example, is −500 [V], and the development potential of 350 [V] acts between the electrostatic latent image and the development sleeve.

In FIG. 1, the imaging unit 18 first uniformly charges the surface of the photoconductor 20 in the charging device 60 along with the rotation of the photoconductor 20. Subsequently, based on image information read by the scanner 300, the laser writing device 21 exposes and scans the surface of the photoconductor 20 by emitting writing light by the laser. Thereby, the electrostatic latent image is formed on the surface of the photoconductor 20. Thereafter, the development device 61 obtains a toner image by developing the electrostatic latent image. This toner image is primarily transferred by the primary transfer device 62 onto the intermediate transfer belt 10. Residual toner remaining on the surface of the photoconductor 20 after the primary transfer is removed by the photoconductor cleaning device 63 and then the surface of the photoconductor 20 is neutralized by the neutralization device 64 and offered for the next image formation.

In FIG. 2, the secondary transfer roller 24 which is a secondary transfer device is provided at a position opposing the third support roller 16 among the three support rollers. Then, when the toner image on the intermediate transfer belt 10 is secondarily transferred onto the recording sheet 5, the secondary transfer roller 24 forms a secondary transfer nip pressed against the part of the intermediate transfer belt 10 wound around the third support roller 16. The roller cleaning unit 91 configured to clean toner adhered to the secondary transfer roller 24 abuts against the secondary transfer roller 24. Also, as the secondary transfer device, for example, a configuration using a transfer belt or a non-contact transfer charger may be used instead of a configuration using the secondary transfer roller 24.

An endless belt-shaped conveyance belt 22 extended by the two rollers 23*a* and 23*b* is arranged at a position downstream from the secondary transfer roller 24 in the transport direction of the recording sheet 5. In addition, a fixing device 25 for fixing the toner image to the recording sheet 5 is provided at a position further downstream from the conveyance belt 22 in the transport direction. The fixing device 25 has a configuration in which a pressure roller 27 is pressed against a heating roller 26. In addition, a belt cleaning device 17 is provided at a position opposing the second support roller 15 among the support rollers of the intermediate transfer belt 10. The belt cleaning device 17 is a belt cleaning device for removing residual toner remaining on the intermediate transfer belt 10 after the toner image on the intermediate transfer belt 10 has been transferred to the recording sheet 5.

As illustrated in FIG. 1, a transport passage 48 configured to guide the recording sheet 5 fed from the sheet feeder 200 to the discharge tray 7 via the secondary transfer roller 24 is provided in the print section 100. In addition, a transport roller 49*a*, a registration roller 49*b*, a discharge roller 56, etc. are provided at positions along the transport passage 48. At a position downstream from the transport passage 48, a switching pawl 55 configured to switch the transport direction of the recording sheet 5 after the transfer, to the discharge tray 7 or a sheet reversing device 93 is provided. The sheet reversing device 93 sends the recording sheet 5 toward the secondary transfer roller 24 again by reversing the recording sheet 5.

In the print section 100, a bypass feed passage 53 merging the bypass tray 6 and the transport passage 48 is also provided. At a position upstream from the bypass feed passage 53, a sheet feed roller 50 and a separation roller 51 for feeding recording sheets 5 set on the bypass tray 6 one by one are provided.

The sheet feeder 200 has a plurality of sheet-feed trays 44 in which the recording sheets 5 are housed, a sheet feed roller 42 and a separation roller 45 configured to send out the recording sheets housed in the sheet-feed trays 44 one by one, a transport roller 47 configured to transport the sent recording sheet along a feed passage 46, etc. The feed passage 46 is connected to the transport passage 48 of the print section 100.

The scanner 300 causes first and second traveling bodies 33 and 34 equipped with a document illumination light source and a mirror to reciprocally move in order to read and scan a document placed on an exposure glass 31. Image information scanned by these traveling bodies 33 and 34 is condensed by the imaging lens 35 on an imaging plane of a reading sensor 36 installed after an imaging lens 35, and read by the reading sensor 36 as an image signal.

When a document is copied using this copier, the document is first set on a document mount 30 of the ADF 400. Alternatively, the document is set on the exposure glass 31 of the scanner 300 by opening the ADF 400. The ADF 400 is closed to press the document. Thereafter, if the user presses a start key, the document is transported onto the exposure glass 31 when the document is set on the ADF 400. Thus, the scanner 300 is driven and the first traveling body 33 and the second traveling body 34 start to travel. Thereby, light from the first traveling body 33 is reflected by the document on the exposure glass 31, and the reflected light is reflected by the mirror of the second traveling body 34 and guided to the reading sensor 36 through the imaging lens 35. Thereby, the image information of the document is read.

In addition, when the user presses the start key, a driving motor is driven, one of the support rollers 14, 15, and 16 is rotationally driven and the intermediate transfer belt 10 is rotationally driven. In addition, simultaneously, the photoconductors 20Y, 20C, 20M, and 20K of the imaging units 18Y, 18C, 18M, and 18K are also rotationally driven. Thereafter, based on the image information read by the reading sensor 36 of the scanner 300, the laser writing device 21 irradiates the photoconductors 20Y, 20C, 20M, and 20K of the imaging units 18Y, 18C, 18M, and 18K with writing light. Thereby, electrostatic latent images are formed on the photoconductors 20Y, 20C, 20M, and 20K and become visual images by development devices 61Y, 61C, 61M, and 61K. Then, Y, C, M, and K toner images are formed on the photoconductors 20Y, 20C, 20M, and 20K, respectively.

Color toner images formed in this manner are primarily transferred to be sequentially superimposed on the intermediate transfer belt 10 by the primary transfer rollers 62Y, 62C, 62M, and 62K. Thereby, on the intermediate transfer belt 10, a composite toner image obtained by superimposing color toner images is formed. Also, residual toner remaining on the intermediate transfer belt 10 after the secondary transfer is removed by the belt cleaning device 17.

In addition, when the user presses the start key, the sheet feed roller 42 of the sheet feeder 200 according to the recording sheet 5 selected by the user rotates and the recording sheet 5 is sent out from one of the sheet-feed trays 44. The recording sheet 5 sent out therefrom is separated by the separation roller 45 as one sheet, enters the feed passage 46, and is transported by the transport roller 47 to the transport passage 48 within the print section 100. Thus, the transported recording sheet 5 stops at a position abutting the registration roller 49*b*.

The registration roller 49*b* starts to rotate according to a timing at which the toner image formed on the intermediate transfer belt 10 is transported to a secondary transfer section opposing the secondary transfer roller 24 as described above. The recording sheet 5 sent out by the registration roller 49*b* is sent between the intermediate transfer belt 10 and the secondary transfer roller 24, and the toner image on the intermediate transfer belt 10 is secondarily transferred by the secondary transfer roller 24 onto the recording sheet 5. Thereafter, the recording sheet 5 is transported to the fixing device 25 in a state in which the recording sheet 5 is suctioned to the secondary transfer roller 24 and the toner image is fixed by heat and pressure in the fixing device 25.

The recording sheet 5 passing through the fixing device 25 is discharged and stacked on the discharge tray 7 by the discharge roller 56. Also, after the transport direction of the recording sheet 5 passing through the fixing device 25 is switched by the switching pawl 55 when image formation is also performed on a backside of the side on which the toner image has been fixed, the recording sheet 5 is sent into the sheet reversing device 93. The recording sheet 5 is reversed in the sheet reversing device 93 and guided to the secondary transfer roller 24 again.

In the above configuration, when the roundness of the photoconductor 20 is low and the photoconductor 20 is eccentric, the development gap between the photoconductor 20 and the development sleeve 65 fluctuates according to rotation of the photoconductor 20. Thereby, periodic image density unevenness synchronized with a rotation cycle of the photoconductor 20 occurs.

In FIG. 2, this copier includes an optical sensor unit 150 serving as an image-density detector configured to detect image densities of Y, C, M, and K toner images formed by the imaging units 18Y, 18C, 18M, and 18K serving as imagers. This optical sensor unit 150 opposes a winding position around the first support roller 14 in an overall area in a circumferential direction of the intermediate transfer belt 10 at a predetermined clearance from the top surface side of the belt.

The copier according to the embodiment forms a Y solid toner image, a C solid toner image, an M solid toner image, and a K solid toner image for density unevenness detection on the surface of the intermediate transfer belt 10 in a correction data construction process to be described later.

Figure 4:
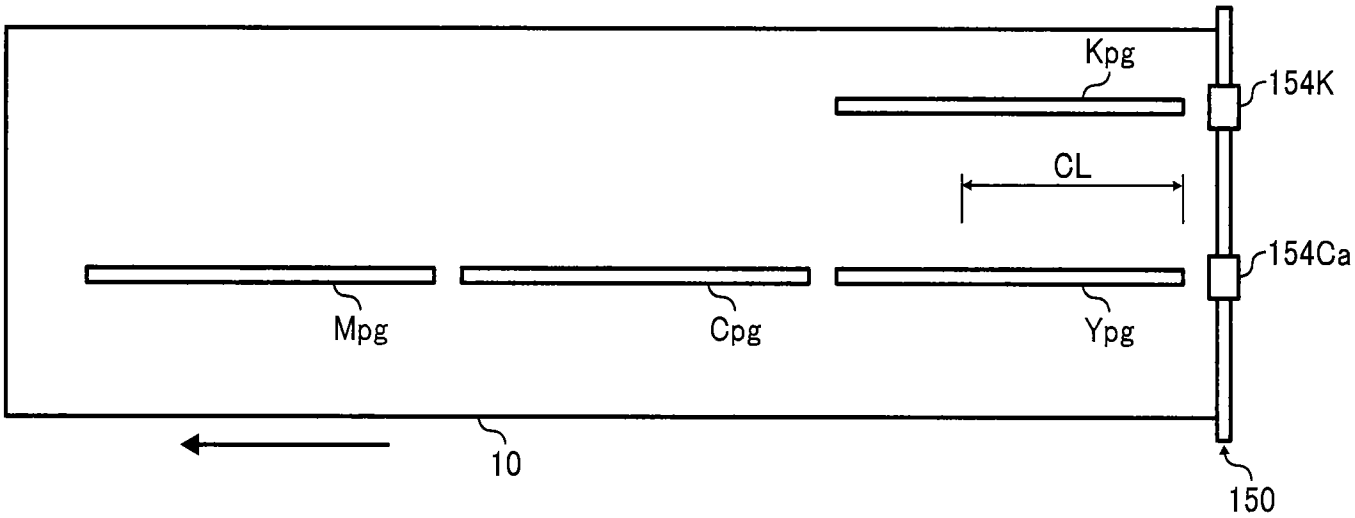
FIG. 4 is a plan view of an intermediate transfer belt of the print section and a solid toner image of each color formed on a surface of the belt.

FIG. 4 is a plan view of the intermediate transfer belt 10 and a solid toner image of each color formed on a surface of the belt. Also, the plan view illustrates the intermediate transfer belt 10 when viewed from bottom to top in a perpendicular direction. The optical sensor unit 150 has a K photo sensor 154K and a color photo sensor 154Ca arranged at a predetermined distance in a belt width direction.

A K solid toner image Kpg is formed in an area at which the K solid toner image Kpg opposes the K photo sensor 154K in an overall area in the belt width direction of the intermediate transfer belt 10. The K solid toner image Kpg has a fine and long shape extending in a belt circumferential direction and its length is greater than a circumferential length of the photoconductor indicated by arrow CL in FIG. 4.

A Y solid toner image Ypg, a C solid toner image Cpg, and an M solid toner image Mpg are formed in an area at which they oppose the color photo sensor 154Ca in the overall area in the belt width direction of the intermediate transfer belt 10. Each of the Y solid toner image Ypg, the C solid toner image Cpg, and the M solid toner image Mpg is formed in a fine and long shape extending in the belt circumferential direction at a mutually shifted position of the belt circumferential direction and its length is greater than the circumferential length CL of the photoconductor.

Figure 5:
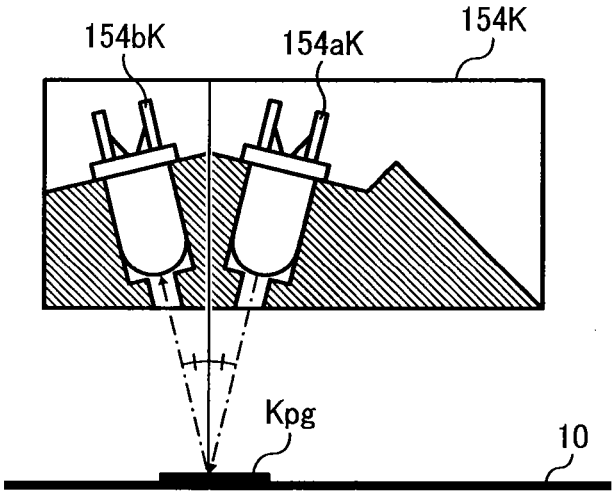
FIG. 5 is an enlarged view of a configuration of a K photo sensor of an optical sensor unit of the print section along with the intermediate transfer belt.

FIG. 5 is an enlarged view of a configuration of the K photo sensor 154K of the optical sensor unit 150 along with the intermediate transfer belt 10. The K photo sensor 154K including a regular-reflection type optical sensor includes a light-emitting element 154*a*K as a light source and a regular-reflection light-receiving element 154*b*K. Then, while regular reflection light regularly reflected by the surface of the K solid toner image Kpg formed on the intermediate transfer belt 10 after being generated from the light-emitting element 154*a*K is received by the regular-reflection light-receiving element 154*b*K, a voltage according to a light reception amount is output from the regular-reflection light-receiving element 154*b*K. A controller detects an image density of the K solid toner image based on variation of an output voltage value from the regular-reflection light-receiving element 154*b*K.

Figure 6:
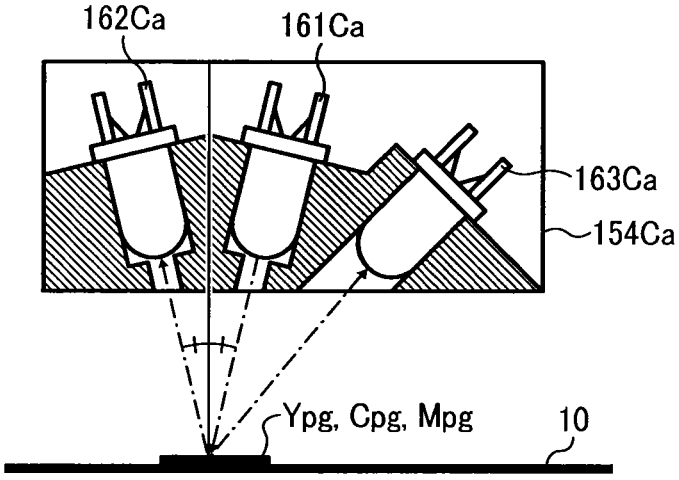
FIG. 6 is an enlarged view of a configuration of a color photo sensor of the optical sensor unit along with the intermediate transfer belt.

FIG. 6 is an enlarged view of a configuration of the color photo sensor 154Ca of the optical sensor unit 150 along with the intermediate transfer belt 10. The color photo sensor 154Ca including a multi-reflection type optical sensor includes a light-emitting element 161Ca serving as a light source, a regular-reflection light-receiving element 162Ca, and a diffuse-reflection light-emitting element 163Ca. After being generated from the light-emitting element 161Ca, regular-reflection light regularly reflected by the surfaces of the Y solid toner image Ypg, the C solid toner image Cpg, and the M solid toner image Mpg formed on the intermediate transfer belt 10 is received by the regular-reflection light-receiving element 162Y. Then, a voltage according to a light reception amount of the regular-reflection light is output from the regular-reflection light-receiving element 162Y. In addition, after being generated from the light-emitting element 161Ca, diffuse-reflection light diffused and reflected by the surfaces of the Y solid toner image Ypg, the C solid toner image Cpg, and the M solid toner image Mpg on the intermediate transfer belt 10 is received by the diffuse-reflection light-emitting element 163Ca. Then, a voltage according to a light reception amount of the diffuse-reflection light is output from the diffuse-reflection light-emitting element 163Ca. The controller identifies image densities of the Y solid toner image Ypg, the C solid toner image Cpg, and the M solid toner image Mpg formed on the intermediate transfer belt 10 based on an output voltage value from the regular-reflection light-receiving element 162Ca and an output voltage value from the diffuse-reflection light-emitting element 163Ca.

In either of the photo sensors 154K and 154Ca, a GaAs infrared LED in which a peak wavelength of an emitted light is 950 [nm] is used as the light-emitting element. In addition, a Si photo transistor in which peak light receiving sensitivity is 800 [nm], etc. is used as the light-receiving element. The peak wavelength and peak light-receiving sensitivity are not limited thereto. A distance between the photo sensor and the belt surface is about 5 [nm].

The detection of the image density of the solid toner image is not limited to an aspect of performing detection on the intermediate transfer belt 10 as in this copier. The image density may be detected on the photoconductor 20 or on the recording sheet. Because a method of obtaining the image density based on the output voltage value from the light-receiving element is disclosed in detail in JP-2007-033770-A, description thereof is omitted.

Figure 7:
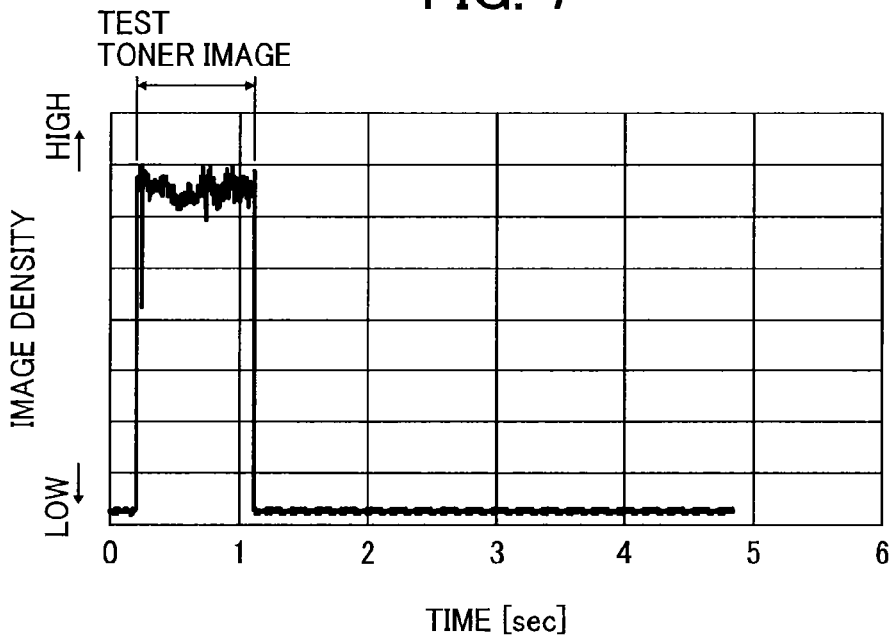
FIG. 7 is a graph of a relationship between image density and elapsed time calculated based on output of the K photo sensor for K solid toner image.

FIG. 7 is a graph of a relationship between an image density and an elapsed time calculated based on an output from the K photo sensor 154K for the K solid toner image. Although a very high image density is detected during a predetermined period as illustrated, the K solid toner image Kpg passes through a position at which the K solid toner image Kpg opposes the K photo sensor 154K during this period. That is, within the above-described period, the image density of each part in the belt traveling direction of the K solid toner image Kpg is detected. Also, the graph of FIG. 7 is created based on a result obtained in experimental conditions as follows. That is, a photoconductor having a diameter of 100 [nm] is used as the photoconductor 20, a process linear velocity is set to 440 [nm/s], a potential of the photoconductor background area is set to −700 [V], a development bias is set to 500 [V], and a laser writing power is set to 70 [%] as the conditions.

Figure 8:
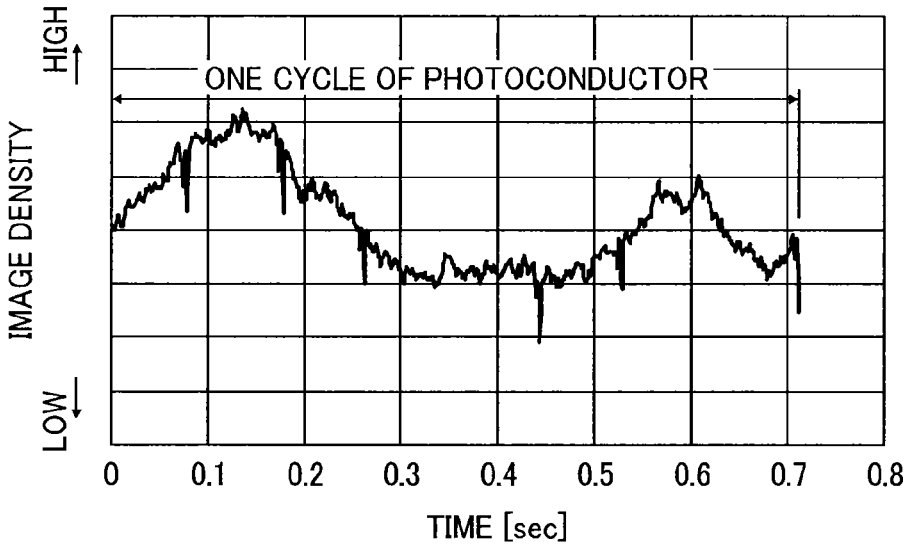
FIG. 8 is a graph of a relationship between image density and elapsed time of the K solid toner image.

FIG. 8 is a graph of a relationship between an image density and an elapsed time of the K solid toner image. As illustrated, the detection result of the image density of the K solid toner image fluctuates with time. This means that the image density of the K solid toner image fluctuates in the circumferential direction of a photoconductor 20K. The fluctuation of such an image density occurs because the development gap varies according to variation of a rotation angular position of the photoconductor 20K due to the eccentricity of the photoconductor 20K.

Although the image density unevenness of the K toner image has been described, the image density unevenness synchronized with each photoconductor rotation cycle due to the eccentricities of the photoconductors 20Y, 20C, and 20M also occurs in the Y toner image, the C toner image, and the M toner image. A fluctuation pattern of a development gap per photoconductor rotation due to the eccentricities of the photoconductors 20Y, 20C, 20M, and 20K is the same as long as the imaging units 18Y, 18C, 18M, and 18K are not replaced. However, because eccentricity amounts of the photoconductors 20Y, 20C, 20M, and 20K are different from those before the replacement if the imaging units 18Y, 18C, 18M, and 18K are replaced, the fluctuation pattern of the development gap per photoconductor rotation varies.

Thus, this copier individually includes replacement detectors, each of which detects the replacement of each of the imaging units 18Y, 18C, 18M, and 18K. As the replacement detectors, for example, it is possible to illustrate an element configured to read ID information of integrated-circuit (IC) tags mounted on the imaging units 18Y, 18C, 18M, and 18K, etc.

In addition, in this copier, a rotational driving force is assigned to the photoconductors 20Y, 20C, 20M, and 20K via a photoconductor gear which rotates integrally with the photoconductor fixed to a rotation shaft. Then, a slit or a reflection mirror is provided in a predetermined area in an overall area in the rotation direction of the photoconductor gear. In addition, a transmissive photosensor or a reflective photosensor for detecting a slit or a reflection mirror is arranged in a predetermined area around the rotation of the photoconductor gear. Then, a combination of the slit or the reflection mirror of the photoconductor gear and the above-described transmissive or reflective photosensor is caused to function as a rotation-angular-position detector configured to detect a predetermined rotation angular position for each of the photoconductors 20Y, 20C, 20M, and 20K. Rotation-angular-position detectors for Y, C, M, and K detect the above-described slit or reflection mirror when the rotating photoconductors 20Y, 20C, 20M, and 20K are at predetermined rotation angular positions within one rotation. Thereby, a detection signal is sent to the controller by detecting a timing at which a predetermined rotation angular position has been reached for the photoconductors 20Y, 20C, 20M, and 20K.

Also, a rotary encoder may be used as the rotation-angular-position detector of each color. When the rotary encoder has been used, it is possible to separately detect each of timings at which various rotation angular positions have been reached for the photoconductor.

Figure 9:
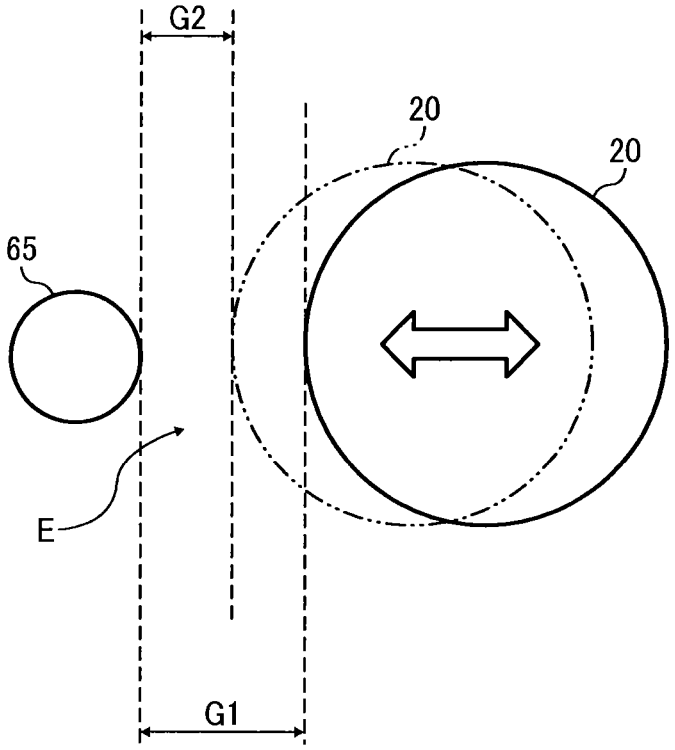
FIG. 9 is a schematic diagram of a relationship between fluctuation of a development gap and fluctuation of a development electric field.

Next, a characteristic configuration of the copier according to the embodiment will be described. FIG. 9 is a schematic diagram of a relationship between fluctuation of a development gap and fluctuation of a development electric field. When the photoconductor 20 is eccentric, the development gap fluctuates according to variation of a rotation angle of the photoconductor 20 as illustrated. The photoconductor 20 indicated by the solid line in the drawing is at a rotation angular position at which the development gap becomes G1 which is a maximum value in one cycle of the photoconductor. In addition, the photoconductor 20 indicated by the dotted line in the drawing is at a rotation angular position at which the development gap becomes G2 which is a minimum value in one cycle of the photoconductor. If a fixed development bias is applied to the development sleeve 65 regardless of a rotation angle in spite of fluctuation of the development gap in this manner, the strength of a development electric field E varies at a surface position of the development sleeve 65 according to the fluctuation of the development gap. When the development gap is narrowed to G2 which is the minimum value, the strength of the development electric field E at a sleeve surface position is maximized in the one cycle of the photoconductor. Thus, the image density becomes highest in the one cycle of the photoconductor. On the other hand, when the development gap is enlarged to G1 which is the maximum value, the strength of the development electric field at a sleeve surface position is minimized in the one cycle of the photoconductor. Thus, the image density becomes lowest in the one cycle.

Figure 10:
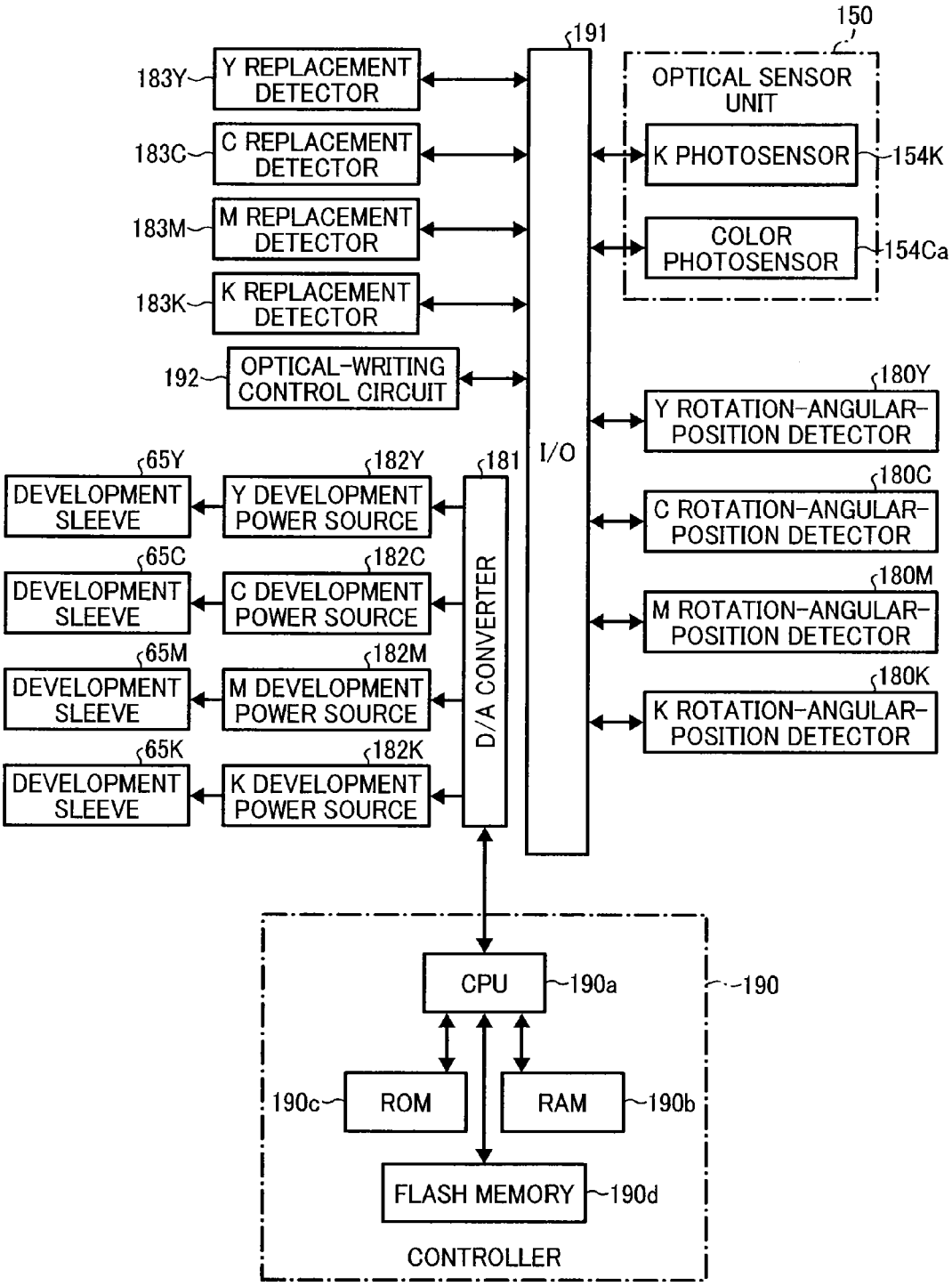
FIG. 10 is a block diagram of part of an electric circuit in the copier.

FIG. 10 is a block diagram of part of an electric circuit in this copier. In FIG. 10, a controller 190 includes a CPU 190*a* serving as a processor, a read only memory (ROM) 190*c* configured to store a control program, etc., a random access memory (RAM) 190*b* configured to temporarily store various types of data, and a flash memory 180*d* configured to store various types of data in an erasable manner. An optical writing control circuit 192 to be exclusively used to control the laser writing device, each photo sensor of the optical sensor unit 150, a digital-to-analog (D/A) converter 181, etc. are connected to the controller 190 via an input-output (I/O) interface 191. In addition, the rotation-angular-position detectors 180Y, 180C, 180M, and 180K for Y, C, M, and K, the replacement detectors 183Y, 183C, 183M, and 183K for Y, C, M, and K, or the like are also connected.

The Y replacement detector 183Y detects the replacement of the imaging unit 18Y. In addition, the C replacement detector 183C, the M replacement detector 183M, and the K replacement detector 183K detect the replacements of the imaging units 18C, 18M, and 18K.

A Y development power source 182Y, a C development power source 182C, an M development power source 182M, and a K development power source 182K are connected to the D/A converter 181 for converting digital data into analog data. These development power sources separately output development biases to development sleeves 65Y, 65C, 65M, and 65K for Y, C, M, and K.

If the photoconductor 20Y during rotational driving is at a predetermined rotation angular position, a Y rotation-angular-position detector 180Y outputs a home-position detection signal to the controller 190 by detecting that the photoconductor 20Y is at the predetermined rotation angular position. Likewise, if the photoconductors 20C, 20M, and 20K are at predetermined rotation angular positions, a C rotation-angular-position detector 180C, an M rotation-angular-position detector 180M, and a K rotation-angular-position detector 180K output home-position detection signals to the controller 190 by detecting that the photoconductors 20C, 20M, and 20K are at the predetermined rotation angular positions.

A Y development correction data table for correcting an output of a development bias from the Y development power source 182Y is stored in a flash memory 190*d* of the controller 190. In addition, a C development correction data table, an M development correction data table, and a K development correction data table for separately correcting outputs of development biases from the C development power source 182C, the M development power source 182M, and the K development power source 182K are also stored. These development correction data tables, for example, are development correction data tables storing data for expressing an output fluctuation pattern of a development bias for generating a density change having a phase opposite to image density unevenness occurring in a photoconductor rotation cycle illustrated in FIG. 8. These tables are tables constructed based on results obtained by checking image density unevenness waveforms generated in the photoconductor rotation cycle through previous experiments.

When the home-position detection signal is sent from the Y rotation-angular-position detector 180Y, the controller 190 reads correction data of table No. 1 in the Y development correction data table and outputs a control signal corresponding to its result toward the Y development power source 182Y. After the output control signal is converted into an analog signal, the analog signal is input to the Y development power source 182Y. Then, the Y development power source 182Y causes a value of the development bias output to the development sleeve 65Y to be changed to a value according to its control signal.

For example, because the development gap is wider than a standard value at the timing at which the photoconductor 20Y has come to a predetermined rotation angular position, the image density is assumed to be lower than a target density in the condition of a development bias of −500 [V]. Thus, in order to set the value to the target density, the development bias which is a predetermined control parameter capable of varying development performance of the imaging unit 18Y is assumed to be necessarily set to −510 [V] as proved through previous experiments. In this case, in table No. 1 of the Y correction table, correction data for varying an output value of the development bias from the Y development power source 182Y to −510 [V] is stored. Thus, if the controller 190 outputs a control signal based on its correction data, an output value of the development bias from the Y development power source 182Y is varied to −510 [V]. Thereby, at a timing at which the photoconductor 20Y has come to a predetermined rotation angular position, it is possible to develop an electrostatic latent image in a target density.

If the controller 190 outputs a control signal corresponding to correction data of table No. 1 in the Y development correction data table based on a fact that the home-position detection signal is sent from the Y rotation-angular-position detector 180Y, the following process is performed. That is, the correction data is read while the table numbers of data read from the Y development correction data table are shifted one by one at predetermined time intervals, and a control signal corresponding to its result is output to the Y development power source 182Y. Thereby, an output fluctuation pattern of the development bias for generating density variation of a phase opposite to the Y image density unevenness occurring in the photoconductor rotation cycle is expressed by the development device 61Y for Y. The controller 190 executes such a series of processes as an output control process.

Although control of the development bias for Y has been described, the controller 190 also performs a similar output control process in development biases for C, M, and K. Also, when the controller 190 is configured to cause a pulse width modulation (PWM) signal to be transmitted as a control signal, the D/A converter 181 can be omitted.

Figure 11:
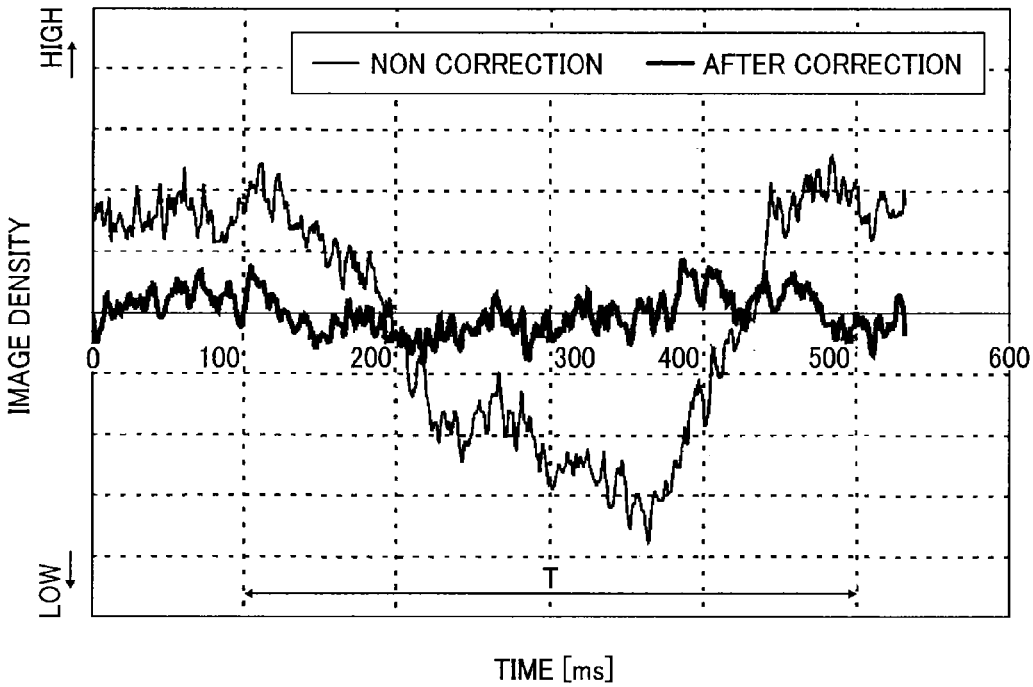
FIG. 11 is a graph of a relationship between fluctuation of an image density and control of a development bias.

FIG. 11 is a graph of a relationship between fluctuation of an image density and control of a development bias. In FIG. 11, T represents one cycle of the photoconductor. When the development bias is constant without being corrected according to development gap fluctuation (no correction), periodic image density unevenness is caused by development gap fluctuation. FIG. 11 illustrates a waveform when the image density unevenness caused by various factors is extracted for one cycle of the photoconductor. This fluctuation component is mainly caused by the eccentricity of the photoconductor. This image density unevenness is significantly improved as illustrated by changing the development bias according to development gap fluctuation due to the eccentricity of the photoconductor (after correction). Also, in the image density unevenness, normally, higher-order periodic fluctuation components generated in ½ cycle, ⅓ cycle, . . . , 1/n cycle are included in addition to a fluctuation component generated in one cycle of the photoconductor. In this case, a waveform in which these fluctuation components are superimposed becomes a complex periodic fluctuation waveform without becoming a clear sine wave.

Figure 12:
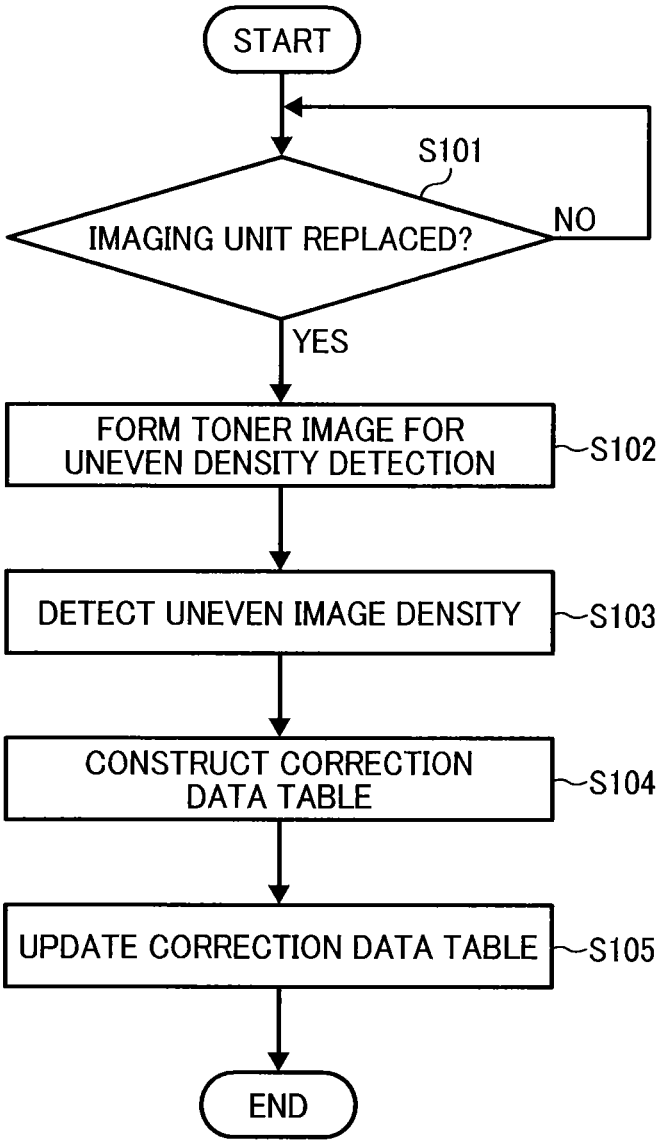
FIG. 12 is a flowchart of a processing flow of a correction data construction process to be executed by a controller of the copier.

When the replacement of the imaging unit 18Y, 18C, 18M, or 18K for each of the colors of Y, M, C, and K is detected, the controller 190 is configured to perform a correction data construction process. FIG. 12 is a flowchart of a processing flow of the correction data construction process to be performed by the controller 190. This correction data construction process is separately performed for each color. For example, when the replacement of the imaging unit 18Y for Y has been detected by the Y replacement detector 183Y, the controller 190 performs the correction data construction process for newly constructing the Y development correction data table.

In the correction data construction process, detection of the replacement of the imaging unit is awaited (N in step 1: hereinafter, the steps are written as S). Then, when the replacement of the imaging unit is detected (Y in S101), a solid toner image is formed on the intermediate transfer belt 10 (S102). A formation start timing of the solid toner image is set to a timing delayed by a predetermined time from a timing at which the home position signal is sent from the rotation-angular-position detector. Thereby, for example, at a timing at which the photoconductor has come to a predetermined rotation angular position, a leading edge enters the development area in the overall area in a longitudinal direction of the solid toner image and development is performed.

Next, the controller 190 identifies an image density of each area in the longitudinal direction of the solid toner image based on an output from the photo sensor 154K or 154Ca, and temporarily stores an identification result in the RAM 190*b*. Thereby, when an unevenness detection or unevenness-detection toner image (pattern image) based on the timing at which the photoconductor 20 has come to the predetermined rotation angular position is obtained (S103), an output fluctuation pattern of the development bias capable of suppressing the image density unevenness is analyzed. Then, based on an analysis result, the development correction data table is constructed (S104) and updated to a development correction data table newly constructed within the flash memory 190*d* (S105).

In this configuration, periodic image density unevenness occurring in the rotation cycle of the photoconductor 20 is suppressed by controlling an output of the development bias to a value corresponding to the rotation angular position of the photoconductor 20 according to correction data read from the development correction data table. Thereby, it is possible to suppress periodic image density unevenness due to fluctuation of the development gap as compared to the image forming apparatus of the related art having only a solution for the periodic image density unevenness occurring in the rotation cycle of the development sleeve 65.

In addition, even when the photoconductor 20 has been replaced in the copier according to the embodiment, the development correction data table corresponding to a component precision error of the photoconductor after the replacement is newly constructed according to execution of the correction data construction process. Thereby, it is possible to avoid the deterioration of the image density unevenness due to inappropriate control of the development bias when the development correction data table corresponding to the eccentricity of the photoconductor 20 before the replacement is also continuously used after the replacement.

The periodic image density unevenness due to the eccentricity of the photoconductor 20 occurs periodically in one rotation cycle of the photoconductor. This is only one piece of periodic image density unevenness due to an error of component precision of the photoconductor 20. As the periodic image density unevenness due to an error of component precision of the photoconductor 20, there are another piece of the periodic image density unevenness, etc. due to an error of roundness of the photoconductor 20.

In addition, as the periodic image density unevenness, there is periodic image density unevenness occurring in the rotation cycle of the development sleeve 65 due to the eccentricity of the development sleeve 65. This image density unevenness periodically occurs in the rotation cycle of the development sleeve 65.

A waveform of a density fluctuation pattern detected in the above-described correction data construction process is a waveform in which a plurality of waveforms is superimposed as follows. That is, this is a waveform in which a waveform of the image density unevenness occurring in cycles of 1/1 to 1/n of the photoconductor rotation cycle due to the error of component precision of the photoconductor 20, a waveform of image density unevenness occurring in the cycles of 1/1 to 1/n of the development sleeve rotation cycle due to the eccentricity of the development sleeve 65, etc. are superimposed.

In this copier, a rotation phase of the photoconductor 20 is not associated (not synchronized) with that of the development sleeve 65, and a relationship between the rotation phases differs according to each print job. For example, a predetermined relationship is assumed to be present between the two rotation phases in a certain print job. However, when the print job ends, rotations of the photoconductor 20 and the development sleeve 65 stop at timings slightly different from each other. Then, because the photoconductor 20 and the development sleeve 65 start to rotate at different accelerations at the initiation of the next print job, the relationship of the rotation phases thereof is different from that in a previous print job. Thus, even when no imaging unit is replaced, the waveform of the density fluctuation pattern detected in the correction data construction process differs according to the relationship between the rotation phases of the photoconductor 20 and the development sleeve 65.

For a waveform of a density fluctuation pattern detected in the correction data construction process, a development correction data table for generating density fluctuation reliably having an anti-phase relationship is assumed to be created. In that case, it may be difficult to effectively reduce periodic image density unevenness even when the development bias is controlled based on the development correction data table.

In the output control process, the correction of the development bias is performed based on a timing at which the home position signal for the photoconductor 20 has been generated so as to suppress image density unevenness due to a component precision error of the photoconductor 20. In this case, it is necessary to extract the uneven density pattern of the rotation cycle generated due to rotational deflection of the photoconductor 20 from the waveform of the uneven density pattern detected in the correction data construction process based on the above-described timing and construct a development correction data table or a charging correction data table based on the extracted pattern. The same is true for the case in which an output of a development bias or a charging bias is periodically changed while the rotation angular position of the development sleeve is monitored.

Figure 13:
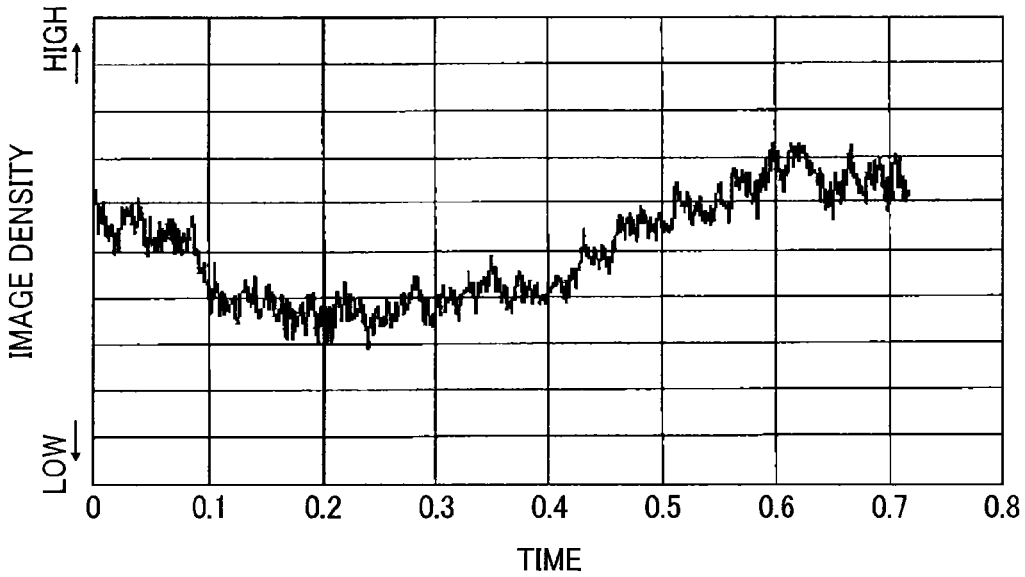
FIG. 13 is a graph of an example of a density fluctuation waveform for one cycle of the photoconductor detected in the correction data construction process.

FIG. 13 is a graph of an example of a density fluctuation waveform for one cycle of the photoconductor detected in the correction data construction process. This density fluctuation waveform includes the image density unevenness of a primary component which increases/decreases in one cycle of the photoconductor once, the image density unevenness of a secondary component which increases/decreases in the one cycle twice, . . . , the image density unevenness of an n-th component which increases/decreases in one cycle of the photoconductor n times. Further, the density fluctuation waveform also includes the image density unevenness occurring in the rotation cycle of the development roller.

Figure 14:
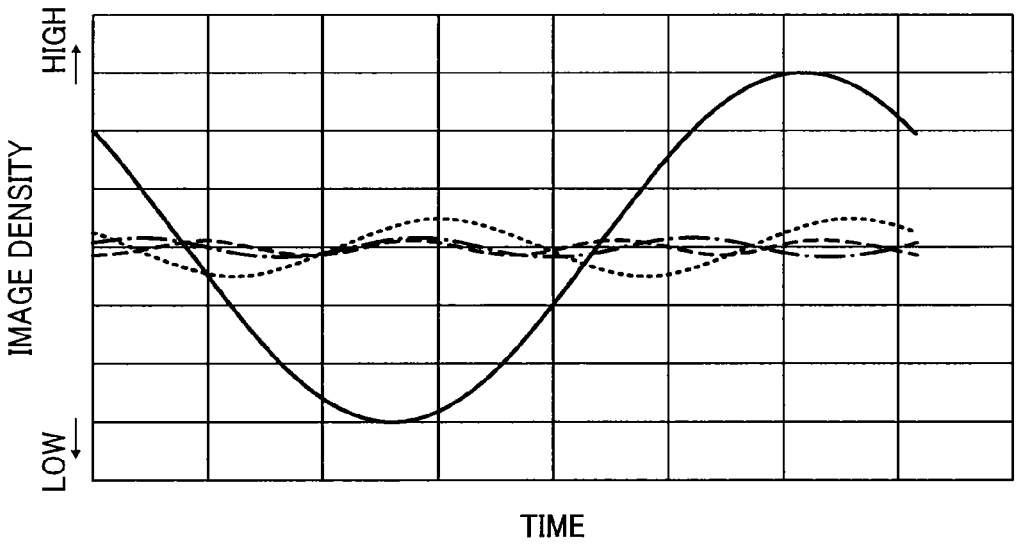
FIG. 14 is a graph of an example of image density unevenness of primary to quaternary components (n=1 to 4) in one cycle of the photoconductor.

FIG. 14 is a graph of an example of image density unevenness of primary to quaternary components (n=1 to 4) in one cycle of the photoconductor. It is possible to extract the image density unevenness of the n-th component of the photoconductor cycle as illustrated by performing a fast Fourier transform (FFT) process or a process of orthogonal detection or the like on data of the detected image density unevenness for one cycle of the photoconductor.

Figure 15:
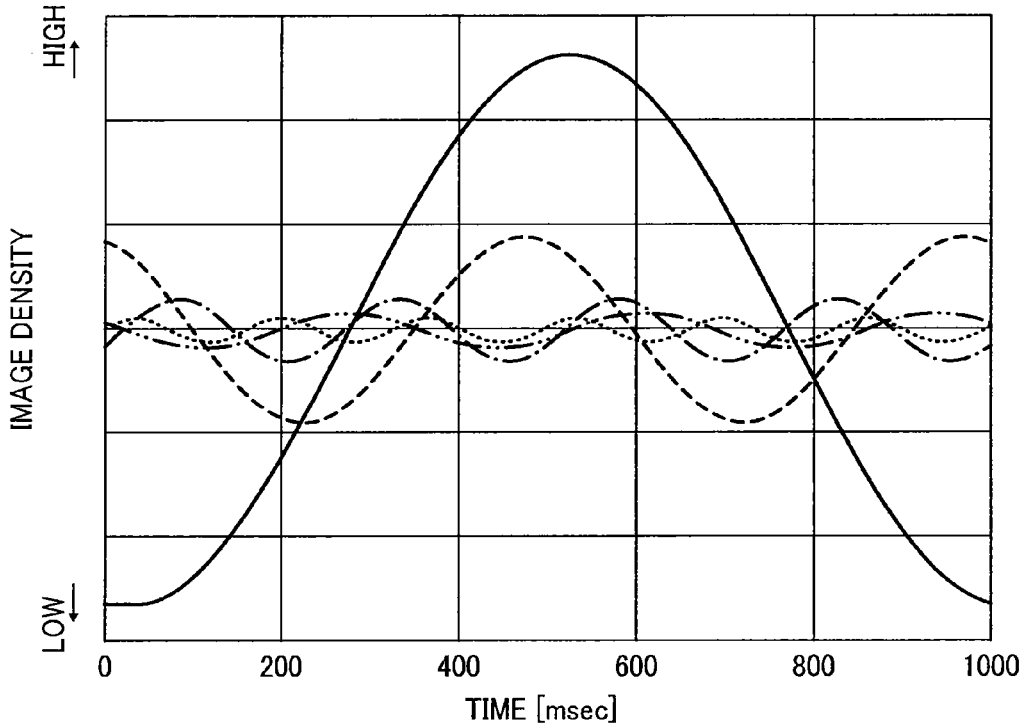
FIG. 15 is a graph of an example of a waveform extracted in the correction data construction process.

Accordingly, the controller 190 performs an FFT process on the density fluctuation waveform extracted for the photoconductor cycle detected in the correction data construction process, thereby extracting a waveform of image density unevenness occurring in the cycles of 1/1 to 1/n of the photoconductor rotation cycle from the waveform. FIG. 15 is a graph of an example of a waveform extracted in this process.

Figure 16:
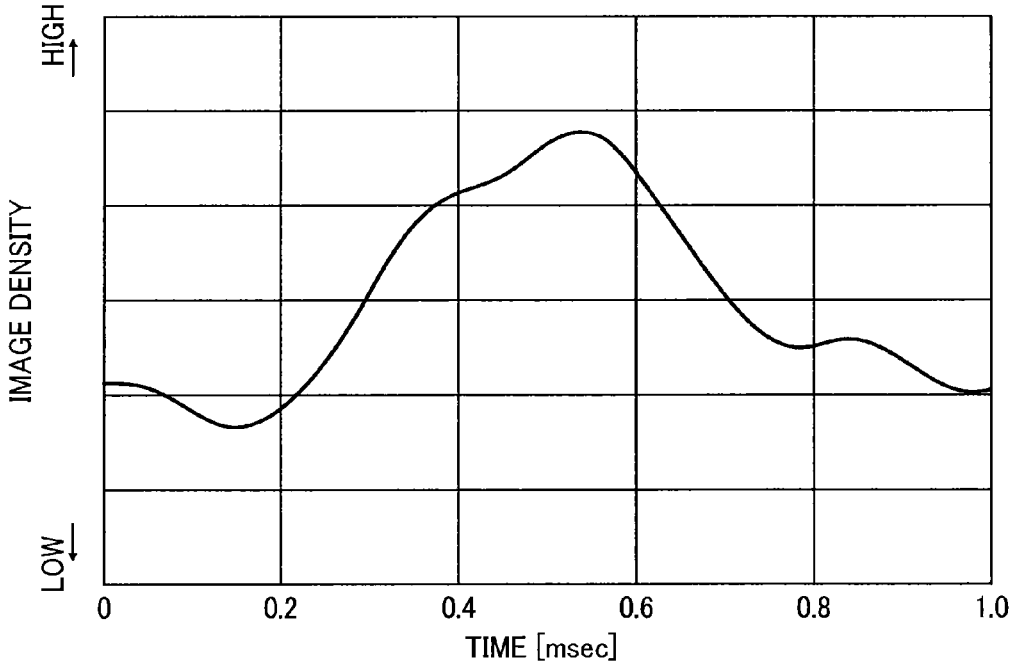
FIG. 16 is a graph of an example of a composite waveform constructed in the correction data construction process.

Next, the controller 190 constructs a composite waveform as illustrated in FIG. 16 by combining extracted image density unevenness waveforms of the primary to n-th components. Then, a development correction data table for causing image density fluctuation having an anti-phase relationship for the composite waveform is constructed. Thereby, the secondary to n-th fluctuation components as well as the primary fluctuation component for the rotation cycle of the photoconductor included in the image density unevenness can suppress its occurrence. Likewise, it is also possible to extract the primary to n-th fluctuation components based on a timing at which the development sleeve has come to a predetermined rotation angular position for the image density unevenness due to a roundness error or eccentricity of the development sleeve and obtain their composite waveform. Consequently, for the image density unevenness due to the roundness error or eccentricity of the development sleeve, the secondary to n-th fluctuation components as well as the primary fluctuation component for the rotation cycle of the development sleeve can be configured to suppress its occurrence.

An algorithm of an output fluctuation pattern of the development bias which generates anti-phase image density fluctuation capable of offsetting the composite waveform can be represented by the following equation.

$$\text{“}Vb=Vbofs+\{A1\cdot\sin(\theta+\phi1)+A2\cdot\sin(2\theta+\phi2)+\ldots+An\cdot\sin(n\cdot\theta+\phi n)\}\text{”}$$

In this equation, Vb represents a standard value of the development bias. In addition, Vbofs represents a correction amount of the development bias. In addition, A1, A2, . . . , . . . , An represent amplitudes of waveforms of density fluctuation patterns generated in cycles of factors of 1, 2, . . . , n of the photoconductor rotation cycle. In addition, $\phi1$, $\phi2$, . . . , $\phi n$ represent phases of the waveforms of the density fluctuation patterns generated in the cycles of the factors of 1, 2, . . . , n of the photoconductor rotation cycle. $\theta$ represents a rotation angle of the photoconductor 20.

Because an attenuation characteristic differs according to a frequency characteristic of a high-voltage power source or the like at each degree, it is necessary to control the amplitude A by correcting the difference. A relational equation of the development bias Vb reflecting the correction is as follows.

$$\text{“}Vb=Vbofs+\{G1\cdot A1\cdot\sin(\theta+\phi1)+G2\cdot A2\cdot\sin(2\theta+\phi2)+\ldots+Gn\cdot An\cdot\sin(n\cdot\theta+\phi n)\}\text{”}$$

In this equation, G1, G2, and G3 represent amplitude control gains according to amplitudes of waveforms of the density fluctuation patterns generated in the cycles of the factors of 1, 2, . . . , n of the photoconductor rotation cycle.

In addition, a relational equation of the development bias to which correction for reflecting a characteristic according to the amplitude is also applied is as follows.

$$\text{“}Vb=Vbofs+Gb\cdot\{G1\cdot A1\cdot\sin(\theta+\phi1)+G2\cdot A2\cdot\sin(2\theta+\phi2)+\ldots+Gn\cdot An\cdot\sin(n\cdot\theta+\phi n)\}\text{”}$$

In this equation, Gb represents a development bias gain according to the amplitude. Based on the equation, the controller 190 is configured to construct a development correction data table.

Figure 17:
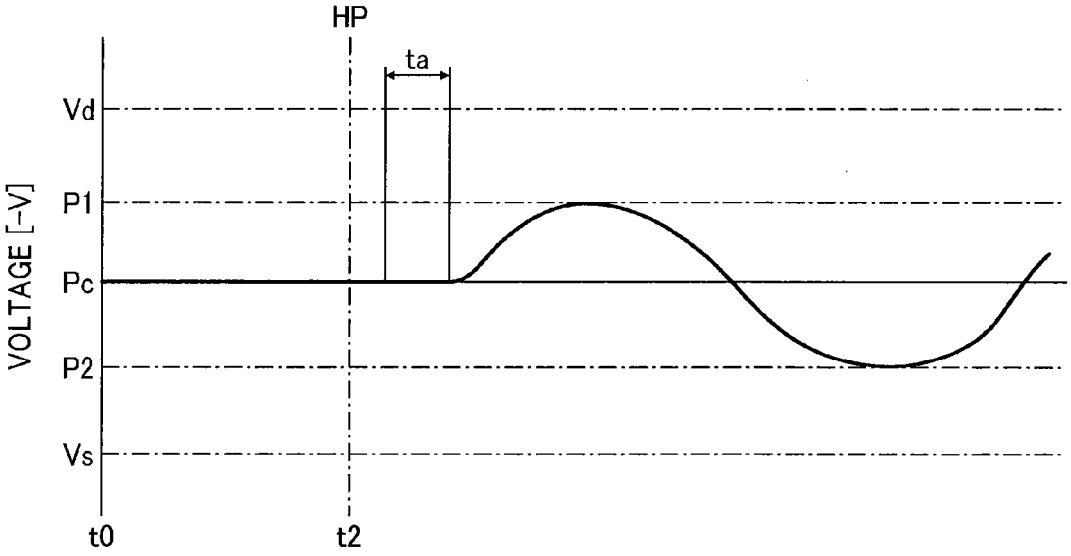
FIG. 17 is a time chart of a time-dependent change of a development bias in the copier according to the embodiment.

FIG. 17 is a time chart of a time-dependent change of a development bias in the copier according to the embodiment. In FIG. 17, t0 is a timing at which application of the development bias for the development sleeve 65 has started. Before the timing t0, the rotational driving of the photoconductor of each color starts or the rotational driving of the development sleeve 65 starts. After a while from the initiation of a print job, the development bias including a DC bias of a fixed value is applied as illustrated. This value is a central value Pc of peak-to-peak amplitude of the fluctuation wave to be described later.

In FIG. 17, all the polarities of units of various types of potentials are negative (−V). Consequently, a background area potential Vd, a maximum value P1 in a periodic fluctuation range, a central value Pc serving as a central value of the periodic fluctuation range, a minimum value P2 in the periodic fluctuation range, and a latent-image potential Vs are all represented by absolute values. Thus, these values have a magnitude relation such as Background Area Potential Vd>Maximum Value P1>Center Value Pc>Minimum Value P2>Latent-Image Potential Vs.

In FIG. 17, t2 represents a timing at which a rotation speed of the photoconductor stabilizes after the print job has started (rotation stability timing). In addition, HP is a timing at which the rotation-angular-position detector 180 has detected a home position (home position detection timing). The home position detection timing is reached after the initiation of the print job. Thereafter, the controller 190 performs the following process at the timing at which a predetermined time ta has elapsed. That is, switching from a process of constantly maintaining the output of the development bias at the central value Pc to a process of periodically changing the output of the development bias based on the development correction data table serving as the development bias control data is performed. A fluctuation waveform that appears due to this switching rises up from the central value Pc as illustrated. That is, the predetermined time ta is a time necessary for the photoconductor to rotate from the home position to the rotation angular position at which the development gap is set to a central value of a fluctuation width. Because the photoconductor has come to the rotation angular position at which the development gap is set to the central value of the fluctuation width at a point in time at which the predetermined time ta has elapsed from the home position detection timing, a proper value of the development bias is set to the central value Pc at that time. Consequently, the fluctuation waveform can rise up from the central value Pc by starting the correction of the development bias based on the development correction data table at that time. That is, at a timing at which a difference from the central value Pc becomes zero, the fluctuation waveform can start to appear.

In order to implement this process, the controller 190 specifies a table number in which a correction value becomes zero for each of the development correction data tables for Y, M, C, and K immediately after the above-described correction data construction process has been performed. Then, based on the table number (zero correction table number) and an interval at which the table number is read, the predetermined time ta which is a time difference from the home position detection timing to the timing at which correction data of the zero correction table number is read is calculated.

Figure 18:
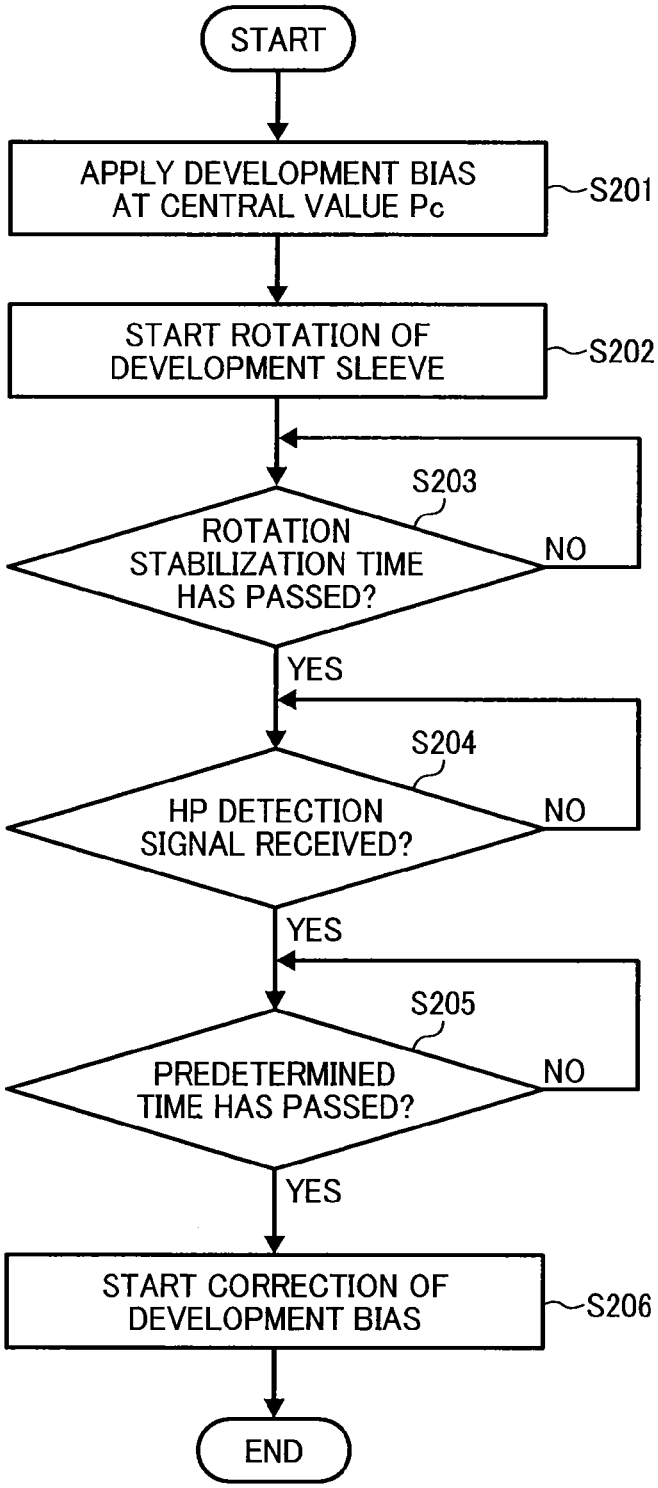
FIG. 18 is a flowchart of a processing flow of job start time bias control to be performed by the controller of the copier.

FIG. 18 is a flowchart of a processing flow of job start time bias control to be performed by the controller 190. When the controller 190 starts the job start time bias control, the application of the development bias of the central value Pc for the development sleeve 65 first starts (S201) and then the rotation of the development sleeve starts (S202). At this time, a time-dependent process simultaneously starts. Thereafter, the process includes waiting until a predetermined rotation stabilization time has elapsed from the rotation start of the development sleeve (S203). When the rotation stabilization time has elapsed (Y in S203), the development sleeve is stable and starts to rotate at a predetermined speed. Thus, next, the process includes waiting for the home-position detection signal to be sent (S204). Then, because it is possible to identify the rotation angular position of the photoconductor when the home-position detection signal is sent, the correction of the development bias based on the development correction data table is possible. However, there is a possibility of a correction amount from the central value Pc of the development bias considerably increasing at the home position detection timing and background staining or carrier adherence being generated when it is corrected by the correction amount. Thus, thereafter, by waiting for a predetermined time ta to elapse (S205), the correction of the development bias based on the development correction data table starts (S206). Thereby, the fluctuation waveform of the development bias can rise up slowly from the central value Pc.

In this configuration, when the development bias is switched to that fluctuating according to the fluctuation waveform from the central value Pc, it is possible to suppress the occurrence of the background staining or carrier adherence by almost removing potential differences before and after the switching of the development bias.

Figure 19:
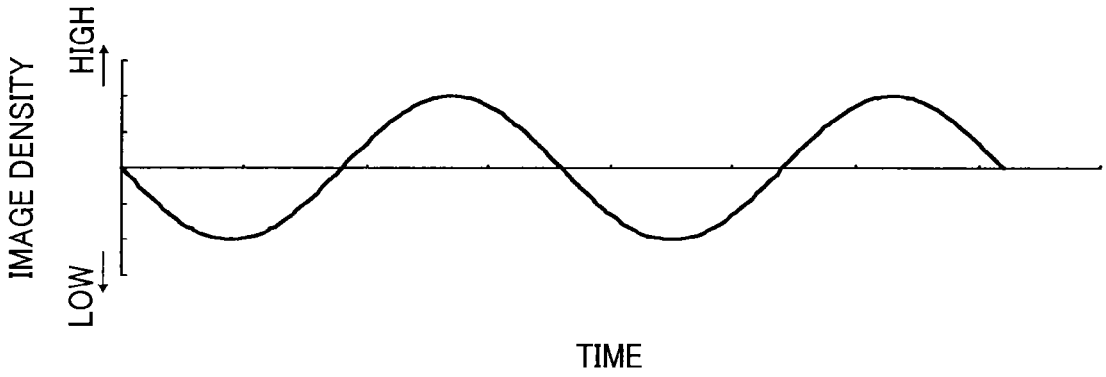
FIG. 19 is a graph of an example of image density unevenness of a solid toner image detected in the correction data construction process.
Figure 20:
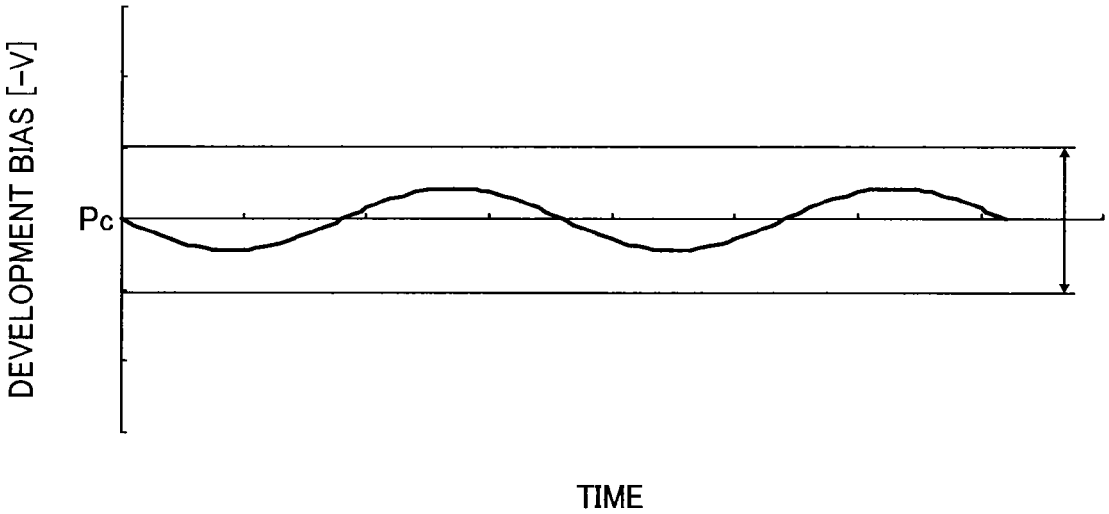
FIG. 20 is a graph of a fluctuation waveform of a development bias to be controlled based on a development correction data table constructed based on the image density unevenness.

FIG. 19 is a graph of an example of image density unevenness of a solid toner image detected in the correction data construction process. In addition, FIG. 20 is a graph illustrating a fluctuation waveform of a development bias to be controlled based on a development correction data table constructed based on the image density unevenness. As illustrated in FIG. 19, in this example, the fluctuation width of the image density unevenness per cycle of the photoconductor is comparatively small. That is, the fluctuation width of the development gap occurring in the rotation cycle of the photoconductor is comparatively small. In this case, the image density fluctuation due to the fluctuation of the development gap becomes hardly visible. Then, as illustrated in FIG. 20, the peak-to-peak amplitude of the fluctuation waveform of the development bias based on the development correction data table is less than or equal to a predetermined value.

When the peak-to-peak amplitude of the fluctuation waveform of the development bias based on the development correction data table is less than or equal to the predetermined value, the controller 190 is configured to perform the following process. That is, a process of continuously outputting the development bias of the central value Pc is performed in place of a process of changing the output of the development bias based on the development correction data table. In further detail, the home position detection time is reached after the initiation of the print job. Even when the predetermined time ta has further elapsed, the central value Pc is also output continuously thereafter without starting a process of changing the development bias. In this configuration, when the fluctuation width of the image density fluctuation occurring in the photoconductor cycle is comparatively small, it is possible to lengthen the life of the controller 190 by reducing an arithmetic load of the controller 190 without performing the process of changing the development bias. Further, it is possible to avoid a situation in which the image density fluctuation is conversely increased by an erroneous operation, etc. during the development bias fluctuation.

The controller 190 forms a solid toner image of 6 or more rounds of the circumferential length of the photoconductor as the solid toner image Kpg, the Y solid toner image Ypg, the C solid toner image Cpg, or the M solid toner image Mpg illustrated in FIG. 4. Then, after the photo sensor starts to detect each solid toner image, image density unevenness until the one cycle of the photoconductor has elapsed is set as the image density unevenness for the one cycle of the photoconductor. Thereafter, every time the one cycle of the photoconductor has elapsed, the image density unevenness is detected as the image density unevenness for the one cycle of the photoconductor. Thereby, the image density unevenness from first to sixth rounds of the photoconductor is detected, and a fluctuation waveform of the image density unevenness per round of the photoconductor is constructed based on a result obtained by superimposing and averaging image density unevenness fluctuation waveforms of these rounds. In this configuration, it is possible to more accurately detect the image density unevenness as compared to when the image density unevenness for one cycle of the photoconductor is detected.

Figure 21:
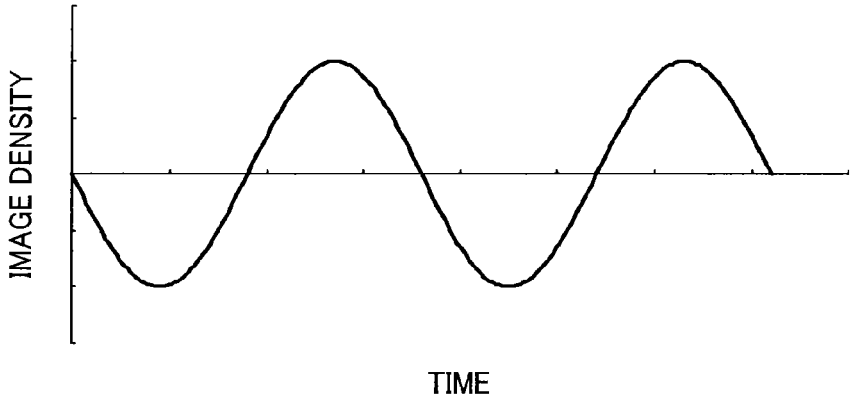
FIG. 21 is a graph of an example of a waveform part specified as the image density unevenness from a first round of the photoconductor to a second round.
Figure 22:
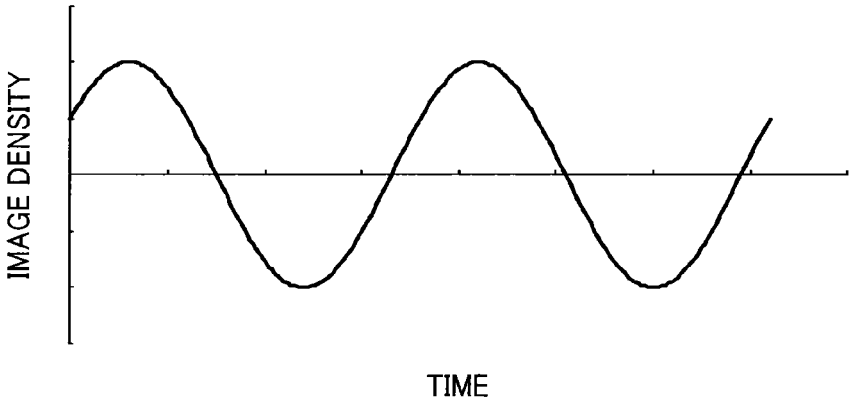
FIG. 22 is a graph of an example of a waveform part specified as the image density unevenness from a third round of the photoconductor to a fourth round.
Figure 23:
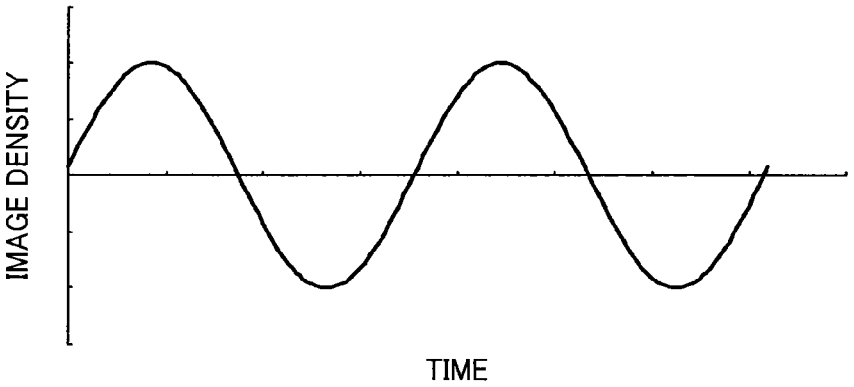
FIG. 23 is a graph of an example of a waveform part specified as the image density unevenness from a fifth round of the photoconductor to a sixth round.

However, there is a possibility of a phase shift occurring in a fluctuation waveform of the image density unevenness of each round due to sudden rotation speed unevenness of the photoconductor, etc. For example, FIG. 21 is a graph of an example of a waveform part specified as the image density unevenness from a first round of the photoconductor to a second round. In addition, FIG. 22 is a graph illustrating an example of a waveform part specified as the image density unevenness from a third round of the photoconductor to a fourth round. In addition, FIG. 23 is a graph illustrating an example of a waveform part specified as the image density unevenness from a fifth round of the photoconductor to a sixth round. With respect to a waveform part (FIG. 21) from the first round to the second round, a waveform part (FIG. 22) from the third round to the fourth round has a phase shift of 30 [deg]. In addition, a waveform part (FIG. 23) from the fifth round to the sixth round has a phase shift of 5 [deg]. Because the phase shift is large in this case, it is difficult to construct the development correction data table capable of offsetting the image density unevenness. In some cases, there is a possibility of the image density unevenness by the correction conversely increasing.

Therefore, when a phase shift exceeding a threshold value occurs in a fluctuation waveform of the image density unevenness detected in each round, the controller 190 is configured to perform the following process. That is, a process of outputting the development bias of the central value Pc is performed in place of changing the output of the development bias based on the development correction data table. In this configuration, it is possible to avoid a situation in which the image density unevenness is conversely increased due to difficulty of accurate detection of the image density unevenness.

Also, although an example in which the output of the development bias is switched from a fixed value to a fluctuation waveform at the timing at which the fluctuation waveform of the development bias appears from the central value Pc of the peak-to-peak amplitude has been described, the appearance timing is not limited to the central value Pc. The fluctuation waveform may appear from a waveform position at which a difference from the central value Pc becomes a predetermined threshold value.

Next, a copier according to a comparative example will be described. Also, a configuration of the copier according to the comparative example is similar to the embodiment except for points specifically mentioned in the following.

First Comparative Example

Although an example of changing the development bias according to the rotation angular position of the photoconductor has been described, the development bias may be changed according to the rotation angular position of the development sleeve in place of or in addition to the above-described change. In this case, it is necessary to extract image density unevenness occurring in a rotation cycle of the development sleeve by performing frequency analysis on an image density fluctuation waveform obtained by detecting the image density unevenness and construct a development correction data table capable of offsetting the image density unevenness.

Figure 24:
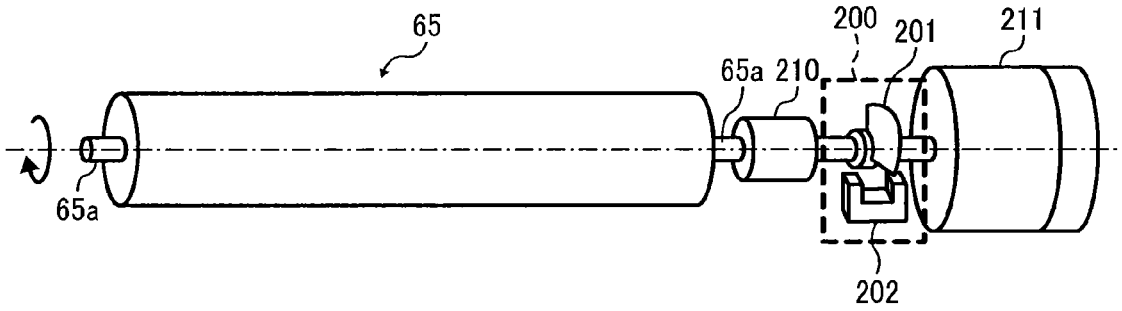
FIG. 24 is an enlarged perspective view of a development sleeve of a copier according to a first comparative example.

FIG. 24 is an enlarged perspective view of the development sleeve. A rotation-angle detection device 200 for detecting a rotation angular position of a development sleeve 65 is arranged in the vicinity of the development sleeve 65. The rotation-angle detection device 200 is arranged in the vicinity of the development sleeve 65Y, 65M, 65C, or 65K of each color. Because these configurations are the same as each other, suffixes Y, M, C, and K attached to a reference numeral are omitted in FIG. 24. A rotation shaft 65*a* of the development sleeve 65 is connected to a sleeve driving motor 211 via a coupling 210. Then, a light shield member 201 is fixed to a motor shaft of the sleeve driving motor 211. When the development sleeve 65 has come to the predetermined rotation angular position, the light shield member 201 enters a photo interrupter 202 and is detected in the photo interrupter 202. Thereby, it is detected that the predetermined rotation angular position has been reached for the development sleeve 65.

Although an example in which a direct driving system for directly connecting the development sleeve to the sleeve driving motor 211 is illustrated in FIG. 24, a deceleration mechanism, etc. may be arranged in the middle of power transmission from the sleeve driving motor 211. However, when the deceleration mechanism is adopted, it is desirable that the light shield member 201 have the same number of rotations as the development sleeve 65.

Figure 25:
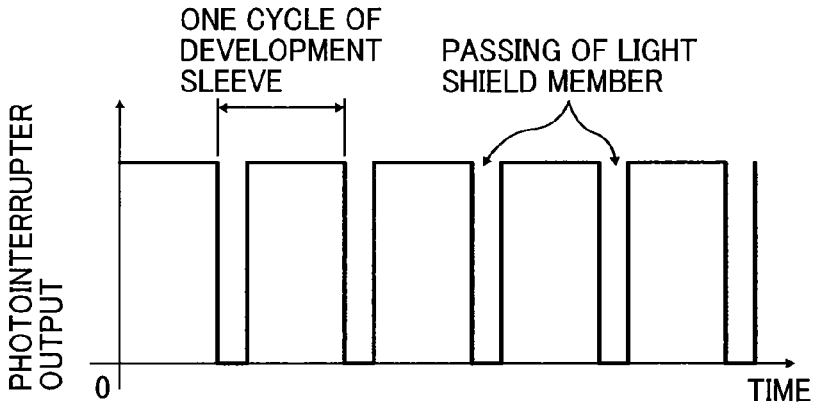
FIG. 25 is a graph of an output change of a photo interrupter of the copier.

FIG. 25 is a graph of an output change of the photo interrupter 202. For each cycle of the development sleeve 65, an output of the photo interrupter 202 rises up in a rectangular shape only once. This rising timing is a timing at which the development sleeve 65 has come to the predetermined rotation angular position.

Figure 26:
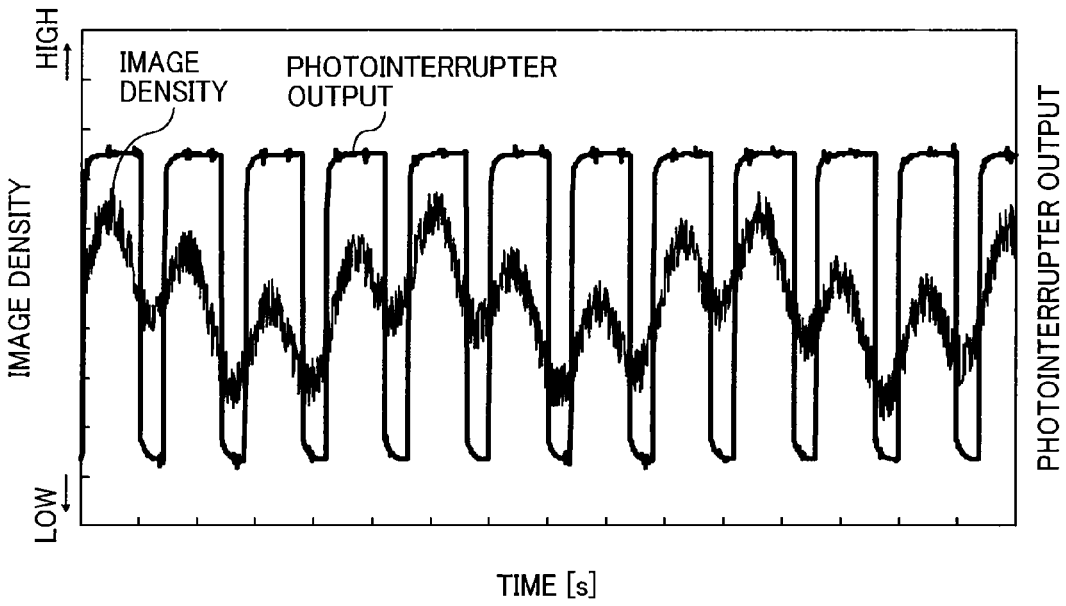
FIG. 26 is a graph of a time-dependent change of an image density and a time-dependent change of an output of the photo interrupter.

FIG. 26 is a graph of a time-dependent change of the image density and a time-dependent change of the output of the photo interrupter 202. As the fluctuation of the image density, image density fluctuation synchronized with a cycle of the photo interrupter 202 and image density fluctuation which varies in an overall sine wave shape in a cycle greater than the cycle of the photo interrupter 202 are present. The occurrence of a sine wave shape in a pulse cycle of the photo interrupter 202 is the image density unevenness due to fluctuation of the development gap according to rotation of the development sleeve 65. In addition, the variation in an overall sine wave shape in a cycle greater than the pulse cycle of the photo interrupter 202 is the image density unevenness due to fluctuation of the development gap according to rotation of the photoconductor. After constructing a waveform of image density unevenness as illustrated by detecting a solid toner image of each color, the controller 190 extracts only a waveform component occurring in the pulse cycle of the photo interrupter 202. Then, the fluctuation waveform of the development bias capable of offsetting the waveform component is constructed and the development correction data table is constructed based on a construction result.

Figure 27:
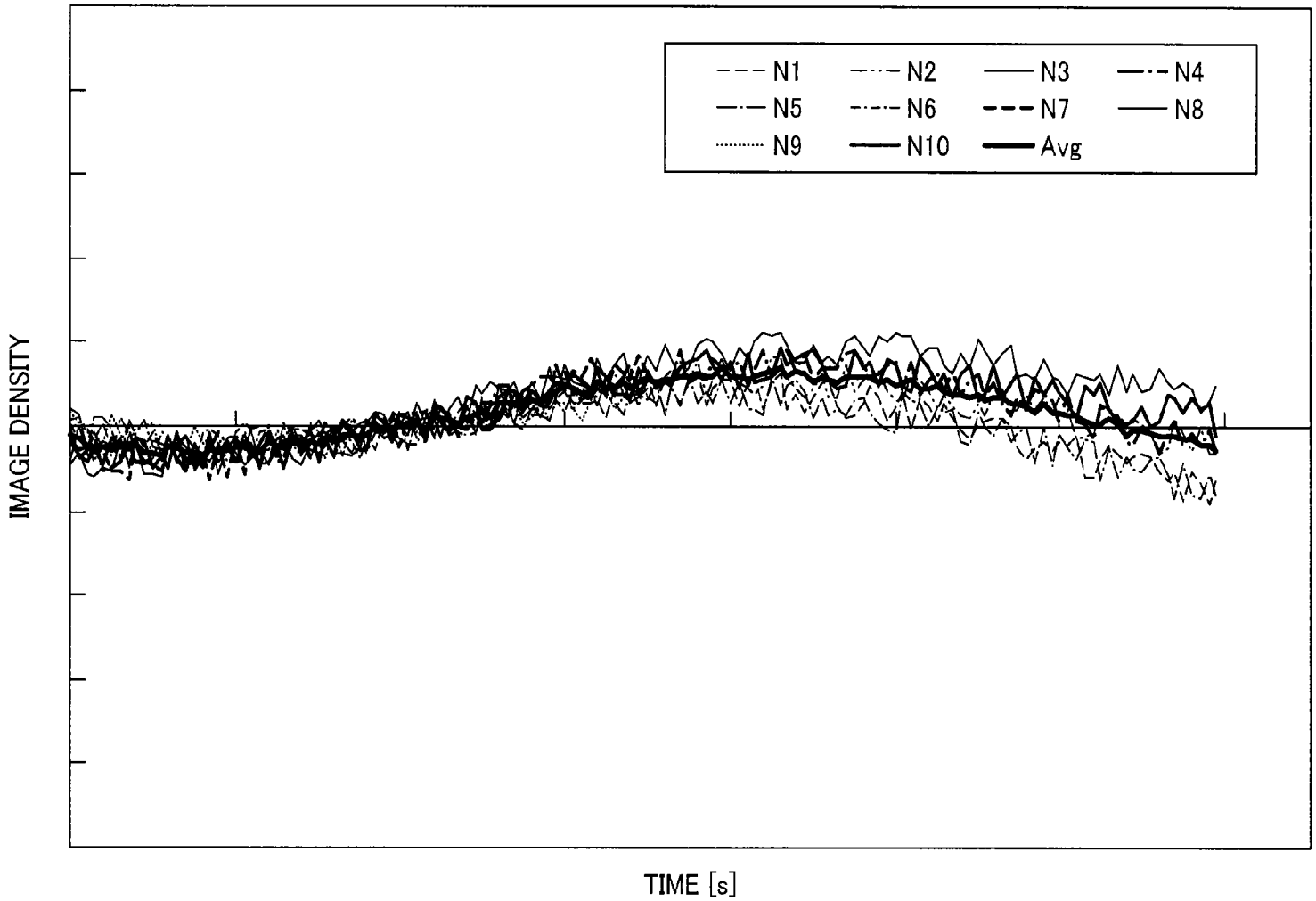
FIG. 27 is a graph obtained by dividing a fluctuation waveform of an image density of the solid toner image in a length of each development sleeve rotation cycle and superimposing divisions.

FIG. 27 is a graph obtained by dividing a fluctuation waveform of an image density of the solid toner image in a length of each development sleeve rotation cycle and superimposing divisions. In the illustrated example, an example in which a fluctuation waveform of ten cycles of the development sleeve is divided into ten waveforms N1 to N10 and the 10 waveforms are superimposed is illustrated. In FIG. 27, a waveform Avg indicated by the thick line is an average of these ten division waveforms N1 to N10. Although these division waveforms N1 to N10 include different periodic fluctuation components from each other, the average waveform Avg is configured to hardly include these periodic fluctuation components. In this manner, it is possible to extract an image density fluctuation component occurring in a rotation cycle of the development sleeve by averaging a plurality of division waveforms. The controller 190 is configured to only extract a waveform component occurring in the pulse cycle of the photo interrupter 202 (=the rotation cycle of the development sleeve) according to such an averaging process.

Also, the number of division waveforms may be greater than or equal to 10 or less than 10. In addition, the averaging process may be another averaging process as well as a simple averaging process (arithmetic averaging process).

The controller 190 causes an output of the development bias to vary in the sine wave shape based on the output from the photo interrupter 202 and the development correction data table during the print job. The cycle of the sine wave is the same as the rotation cycle of the development sleeve 65. At the initiation of the print job, as the development bias, a development bias including a DC bias stable at the central value of the peak-to-peak amplitude of the sine wave is first output as in the copier according to the embodiment. Then, after a rotation stabilization time has elapsed from the rotation start of the development sleeve 65, a time-dependent process starts from the timing at which the output of the photo interrupter 202 has initially risen up. At a point in time at which a time-dependent result has come to a predetermined time ta, the development bias starts to be changed in the sine wave shape by reading correction data corresponding to the time point from the development correction data table. Thereby, the fluctuation waveform of the development bias is caused to appear from a central value of its peak-to-peak amplitude.

Second Comparative Example

It is also possible to vary an image density by varying a charging bias applied to a charging roller in place of changing the development bias. When the charging bias is changed, the background area potential Vd fluctuates according to the changed charging bias. Then, because the latent-image potential Vs fluctuates therewith, the development potential also fluctuates. It is possible to change the image density according to the fluctuation of this development potential.

Therefore, the controller 190 of the copier according to the second comparative example constructs a charging correction data table for correcting a charging bias in place of constructing the development correction data table in the correction data construction process. Four charging power-sources separately provided for Y, M, C, and K are connected to the controller 190. The controller 190 can cause an output from the charging power-source to vary by sending respective control signals to these charging power-sources. The controller 190 corrects the charging bias in a correction amount according to a rotation angular position of the photoconductor based on the home position detection timing and the charging correction data table during the print job. Thereby, image density unevenness is prevented from occurring in a rotation cycle of the photoconductor.

Also, at the initiation of the print job, the charging bias of the central value of the peak-to-peak amplitude is first applied to the charging roller until the rotation speed of the photoconductor stabilizes. Thereafter, the home position detection timing is reached and the charging bias starts to be changed based on the charging correction data table at a point in time at which the predetermined time to has further elapsed. Thereby, the fluctuation waveform is caused to appear from the central value of the peak-to-peak amplitude in the fluctuation waveform of the charging bias, so that it is possible to suppress the occurrence of background staining or carrier adherence.

Third Comparative Example

A controller 190 of a copier according to the third comparative example causes a fluctuation waveform to appear from a position of a "first predetermined value" at which a difference from a central value is less than or equal to a predetermined threshold value without generating the fluctuation waveform to appear from a position of the central value in an area for one cycle in the fluctuation waveform when starting periodic fluctuation of a development bias Vb. Thereby, after a home position detection timing, it is possible to start the periodic fluctuation of the development bias Vb in an earlier stage than when waiting for a timing corresponding to the central value of the fluctuation waveform. However, if the development bias Vb which is the central value so far suddenly moves up/down, there is a possibility of slight background staining or carrier adherence being generated even in a slight difference. Accordingly, the development bias Vb starts to gradually vary to a "first predetermined value" step by step at a home position detection timing which is a point in time slightly previous to a timing (hereinafter referred to as a "first timing") at which the fluctuation waveform of the development bias Vb is set to the "first predetermined value." Then, the periodic fluctuation of the development bias Vb starts at the "first timing." Thereby, it is possible to suppress the occurrence of background staining or carrier adherence.

Next, a printer of an example in which more characteristic configurations are added to the copier according to the embodiment will be described. Also, unless mentioned specifically hereinafter, the configuration of the printer according to the example is similar to the embodiment.

Example

The image density unevenness described so far is image density unevenness in a solid part (dark part) of an image. It is possible to suppress the image density unevenness of the solid part of the image due to the fluctuation of the development gap by changing the development bias according to a fluctuation waveform. However, the inventors of the present invention have experimentally found that the image density unevenness is generated in a halftone part of the image when the image density unevenness of the solid part is suppressed in this manner. Specifically, when a value of the development bias is set to about a maximum value P1 in a periodic fluctuation range, the image density of the halftone part is denser than a target. In addition, when the value of the development bias is set to about a minimum value P2 in the periodic fluctuation range, the image density of the halftone part is thinner than the target. This is because, when a difference (amplitude) between the maximum value P1 and the minimum value P2 is set according to the solid part, the amplitude is excessively increased in the halftone part, resulting in image density excess or image density deficiency.

Figure 28:
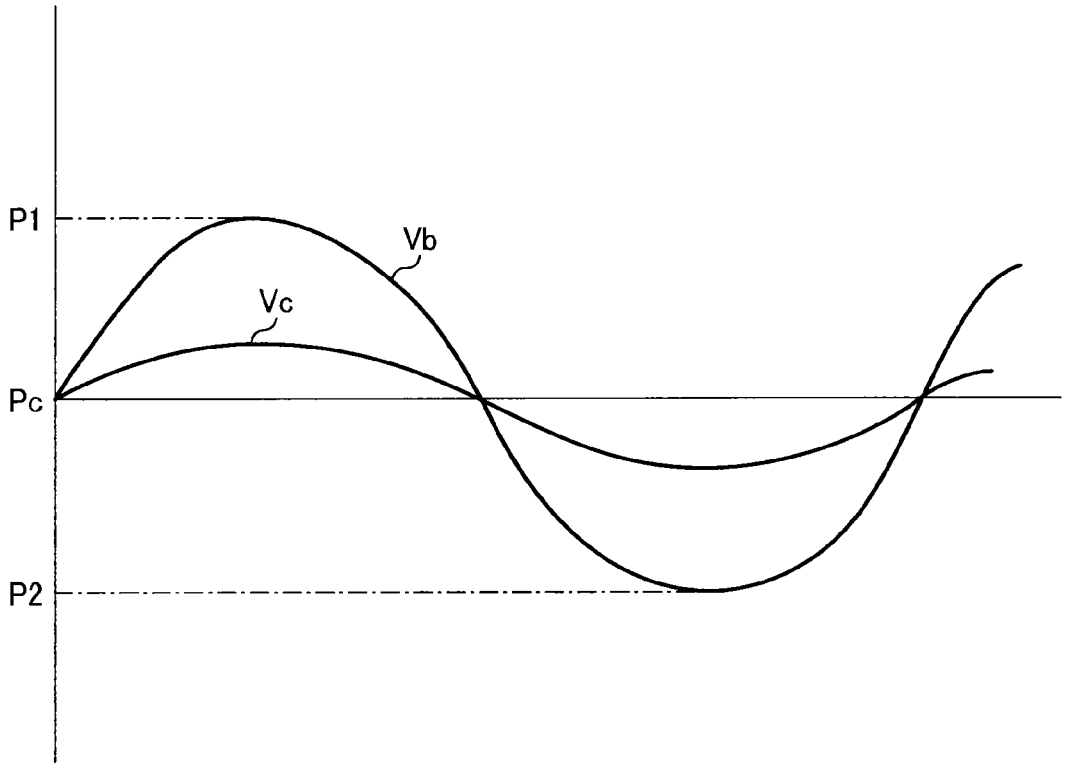
FIG. 28 is a graph of a relationship between a fluctuation waveform of a development bias Vb and a fluctuation waveform of a charging bias Vc.

As a result of further intensive research, the inventors of the present invention have found that the image density unevenness of the halftone part can be suppressed by changing the charging bias in synchronization with a fluctuation cycle of the development bias. FIG. 28 is a graph of a relationship between a fluctuation waveform of a development bias Vb when the output of the development bias Vb is changed according to the development correction data table and a fluctuation waveform of a charging bias Vc when the output of the charging bias Vc is changed according to the charging correction data table. Also, the vertical axis of the graph represents a potential, but the potential represents a shift amount from a central value of the fluctuation waveform. For example, while the central value of the development bias Vb is about −500 [V], the central value of the charging bias Vc is about −700 [V]. However, because the vertical axis is a shift amount from the central value, the two fluctuation waveforms move up/down in a state in which the same position of the vertical axis is designated as the center.

In addition, although a phase of the fluctuation waveform of the development bias Vb is synchronized with a phase of the fluctuation waveform of the charging bias Vc for convenience in FIG. 28, these fluctuation waveforms are actually phase-shifted. This is because there is a time lag until a charging position enters a development area which is an area at which the photoconductor 20 opposed the development device 61 after the surface of the photoconductor 20 has been charged at a position opposing the charging device 60. For example, when the photoconductor 20 is moved by ¼ of its circumferential length to move from the charging position by the charging device 60 to the development area, the fluctuation waveform of the development bias Vb is phase-shifted by 90 [deg] with respect to the fluctuation waveform of the charging bias Vc.

When the development bias Vb is the maximum value P1, the development gap is maximized during one cycle of the photoconductor and the development potential is maximized during one cycle of the photoconductor. Because a photoconductor position at which development is performed according to a maximum value is a charged position in the minimum value P2 of the charging bias Vc, the background area potential becomes highest during one cycle of the photoconductor. Then, because the potential of a latent image obtained by exposure on the background area is highest during one cycle of the photoconductor, the development potential is reduced as compared to when the charging bias Vc is not changed. Thereby, the image density excess of the halftone part is suppressed.

In addition, when the development bias Vb is the minimum value P2, the development gap is minimized during one cycle of the photoconductor and the development potential is minimized during one cycle of the photoconductor. Because a photoconductor position at which development is performed according to the minimum value P2 is a charged position in the minimum value of the charging bias Vc, the background area potential becomes lowest during one cycle of the photoconductor. Then, because the potential of a latent image obtained by exposure on the background area is lowest during one cycle of the photoconductor, the development potential is increased as compared to when the charging bias Vc is not changed. Thereby, the image density deficiency of the halftone part is suppressed.

Accordingly, if the development correction data table is constructed in the above-described correction data construction process, the controller 190 forms four halftone toner images of Y, M, C, and K while changing the development bias based on the development correction data table. These halftone toner images are formed as in the solid toner image illustrated in FIG. 4 except that they are formed in halftone by area gradation. Then, image density unevenness is detected by an optical sensor.

The controller 190 constructs a charging correction data table as follows for each of the colors of Y, M, C, and K. That is, image density unevenness of an n-th component of one cycle of the photoconductor is extracted by performing an FFT process, a process of orthogonal detection, or the like on data of the image density unevenness for one cycle of the photoconductor detected in the halftone toner image. Hereinafter, as in the solid toner image, if a composite waveform of the fluctuation components is constructed, a periodic fluctuation waveform of the charging bias capable of canceling the composite waveform is constructed. Then, based on this waveform, the charging correction data table is constructed.

Figure 29:
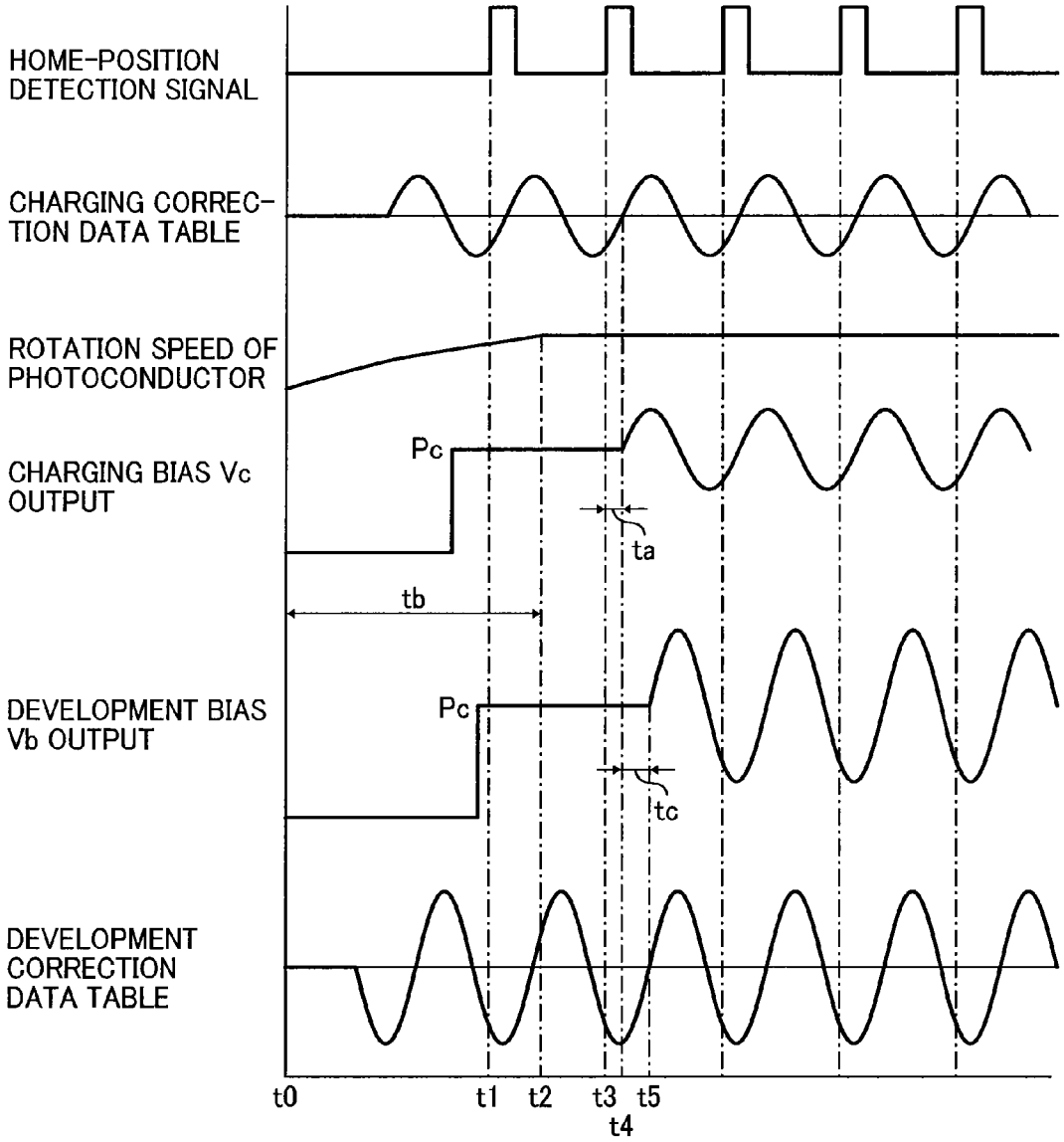
FIG. 29 is a graph of time-dependent changes of the charging bias Vc and the development bias Vb at the initiation of a print job in a copier according to an example.

FIG. 29 is a graph of time-dependent changes of the charging bias Vc and the development bias Vb in a copier according to an example. In this copier, the photoconductor 20 is moved by ¼ of its circumferential length to move from the charging position by the charging device 60 to the development area. Consequently the controller 190 causes the periodic fluctuation waveform of the development bias Vb to be phase-shifted by 90 [deg] with respect to the periodic fluctuation waveform of the charging bias Vc.

The controller 190 starts a time measurement process simultaneously when the rotational driving of the photoconductor starts at a timing of t0 in the drawing. In the copier, it is known that the rotation speed of the photoconductor stabilizes at a predetermined speed tb sec after the rotational driving of the photoconductor has started. In a period (hereinafter referred to as an "acceleration period") until tb sec has elapsed, the rotation speed of the photoconductor is accelerated and the rotation cycle of the photoconductor is progressively shortened without being constant. It is known that the rotation angular position of the photoconductor becomes a home position at the moment at which the home-position detection signal has been generated in such an acceleration period. However, thereafter, it is difficult to identify a degree of a rotation angle until the next home-position detection signal is generated. Thus, it is difficult to accurately perform control of an output of the charging bias based on the charging correction data table or control of an output of the development bias based on the development correction data table. Therefore, if the rotational driving of the photoconductor starts, then the controller 190 waits for the acceleration period to elapse after the charging bias Vc rises up from zero to the central value or the development bias Vb rises up from zero to the central value. Even if the home-position detection signal is generated at a timing t1 before the acceleration period elapses after the charging bias Vc or the development bias Vb rises up in the illustrated example, this timing t1 is not used as a trigger of a bias control switching determination. Also, the charging bias Vc in the acceleration period includes a DC bias stable at the central value of the periodic fluctuation range. In addition, the development bias in the acceleration period includes a DC bias stable at the central value of the periodic fluctuation range.

When the acceleration period (timing t2) has elapsed, the controller 190 starts monitoring of the home-position detection signal. Then, at a timing t3 at which the home-position detection signal has been immediately subsequently received, a time measurement process starts again. In periodically changing the output of the charging bias Vc based on the charging correction data table, an output value is less than the central value and becomes a value close to the minimum value at the timing t3 at which the home-position detection signal has been received. Thus, at the timing t3, the output control of the charging bias Vc is not switched to control based on the charging correction data table. Thereafter, a timing at which an output is possible in the central value of the fluctuation range is chosen. The time measurement process starts at the timing t3 so as to choose this timing. At a time point t4 at which to sec has elapsed from the timing t3, the timing at which the output value can be set to the central value is first visited in periodically changing the output of the charging bias Vc after the timing t3. Therefore, at a time point t4, the controller 190 reads correction data corresponding to its timing from the charging correction data table and switches the output control of the charging bias Vc from a process of controlling the output to the central value to a process of periodically changing the output based on the charging correction data table. Thereafter, at a time point t5 at which tc sec (a predetermined time) has elapsed from the time point t4, a leading edge of a position at which charging is uniformly performed under a condition of the output-controlled charging bias Vc based on the charging correction data table in a circumferential surface of the photoconductor enters a development area. Therefore, the controller 190 chooses the time point t5 and switches the output control of the development bias Vb from the process of constantly maintaining the output in the central value to the process of periodically changing the output c based on the development correction data table. This time point t5 is a timing at which the development bias Vb which is periodically changed is set to the central value of a fluctuation range as illustrated if there is no sudden fluctuation or the like of a photoconductor rotation speed.

In this configuration, it is possible to suppress the occurrence of image density unevenness of a halftone part due to fluctuation of the development bias Vb by changing the charging bias Vc. In addition, at a timing at which a position having a central value appears in an area for one cycle in the fluctuation waveform of the charging bias Vc, switching from a process of constantly maintaining the output of the charging bias Vc in the central value to a process of periodically changing the output of the charging bias Vc is performed. Thereby, it is possible to suppress the occurrence of background staining or carrier adherence.

Also, after switching from the process of constantly maintaining the output of the development bias Vb in the central value to the process of periodically changing the output of the development bias Vb, switching from the process of constantly maintaining the output of the charging bias Vc in the central value to the process of periodically changing the output of the charging bias Vc may be performed. In addition, switching from a process of simultaneously constantly maintaining these bias outputs in the central value to a process of simultaneously periodically changing these bias outputs may be performed. In any case, at a switching time point, the fluctuation waveform is configured to appear from a position at which a difference from the central value is less than or equal to a threshold value.

In addition, although the periodic fluctuation of the development bias is started at a timing at which a photoconductor position charged by the charging bias Vc of a point in time at which the periodic fluctuation has been started enters a development area, it is not always necessary to adopt this configuration. However, it is possible to reliably suppress the occurrence of background staining or carrier adherence by adopting this configuration. This is for the following reasons. When the development bias Vb is periodically changed by uniformly charging the photoconductor 20 as in the embodiment, the background potential is minimized and the background staining easily occurs at a timing at which the maximum value P1 in the development bias Vb is caused to appear. On the other hand, when the charging bias Vc is periodically changed, the background potential is further increased because a position charged at a highest level during one cycle of the photoconductor is caused to enter a development area at the above-described timing. Thereby, it is possible to suppress the occurrence of background staining. Because a photoconductor position charged by the already periodically changed charging bias Vc is caused to enter the development area when the periodic fluctuation of the development bias Vb starts, it is possible to suppress the occurrence of the background staining from that time point.

In addition, when the development bias Vb is periodically changed by uniformly charging the photoconductor 20 as in the embodiment, the background potential is maximized and the carrier adherence is easily caused at a timing at which the maximum value P1 in the development bias Vb is caused to appear. On the other hand, when the charging bias Vc is periodically changed, the background potential is further decreased because a position charged at a lowest level during one cycle of the photoconductor is caused to enter the development area at the above-described timing. Thereby, it is possible to suppress the occurrence of carrier adherence. Because a photoconductor position charged by the already periodically changed charging bias Vc is caused to enter the development area when the periodic fluctuation of the development bias Vb starts, it is possible to suppress the occurrence of the carrier adherence from that time point.

When the periodic fluctuation range of the charging bias Vc based on the charging correction data table is less than or equal to a predetermined fluctuation width, the controller 190 is configured to perform the following process. That is, a process of continuously outputting the charging bias Vc of the central value is performed in place of a process of changing an output of the charging bias Vc based on the charging correction data table. In further detail, even when the home position detection timing has been reached after the initiation of a print job and a predetermined time to has further elapsed, the central value is continuously output thereafter without starting a process of changing the charging bias Vc. In this configuration, when the fluctuation width of the image density fluctuation occurring in the photoconductor cycle is comparatively small, it is possible to lengthen a life of the controller 190 by reducing an arithmetic load of the controller 190 without performing a process of changing the charging bias Vc. Further, it is possible to avoid a situation in which the image density fluctuation is conversely increased by an erroneous operation, etc. during the charging bias fluctuation.

Figure 30:
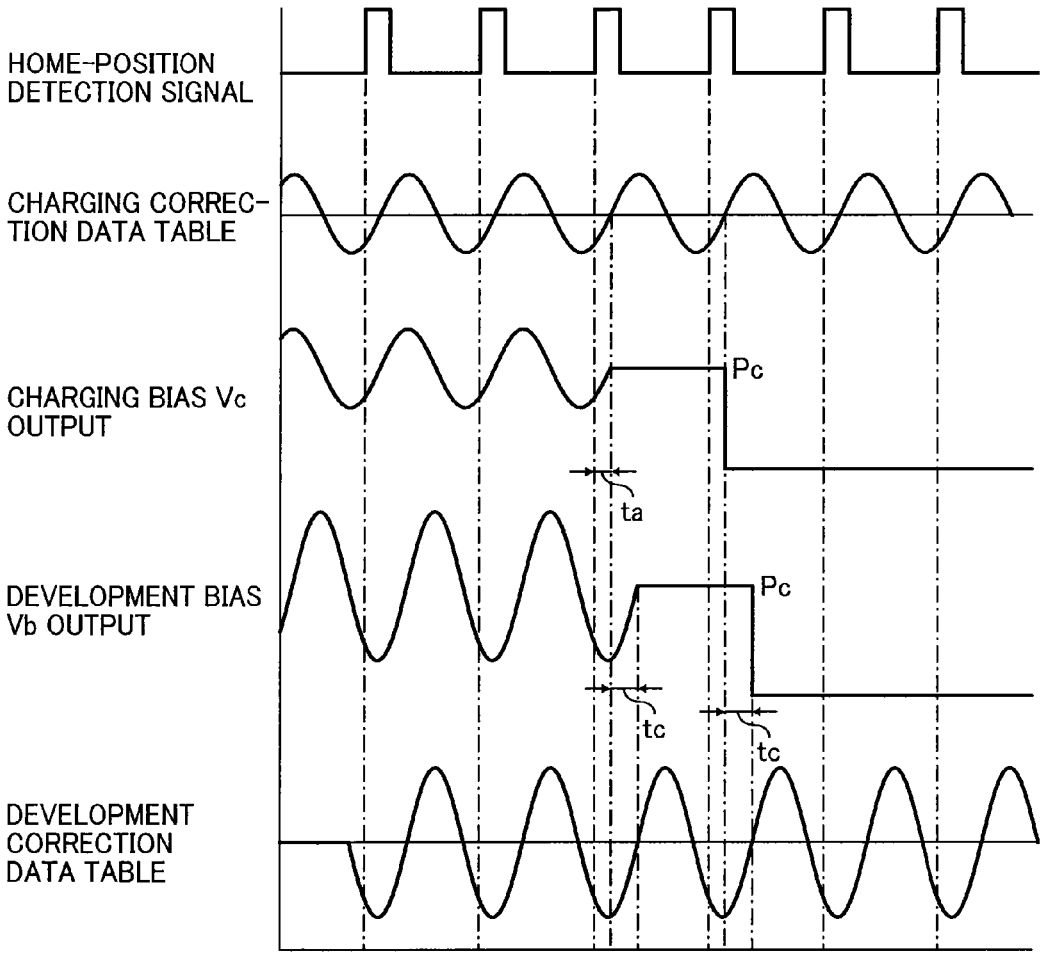
FIG. 30 is a graph of time-dependent changes of the charging bias Vc and the development bias Vb at the end of the print job in the copier according to an example.

The controller 190 first monitors a timing at which the home-position detection signal is generated as illustrated in FIG. 30 at the end of the print job and further waits for ta sec to elapse if the timing has been reached. A timing ta sec after the home-position detection signal has been generated is a timing at which an output value of the output-controlled charging bias Vc based on the charging correction data table as described above becomes the central value of the fluctuation range. At this timing, the controller 190 performs switching from a process of changing the output of the charging bias Vc based on the charging correction data table to a process of maintaining the output of the charging bias Vc in a constant central value as illustrated. Thereafter, at a timing at which a leading edge of a position at which the charging process has been performed in the central value in the circumferential surface of the photoconductor enters the development area, that is, a timing at which tc sec (¼ cycle) has elapsed from a timing at which the output control of the charging bias has been switched, the following switching is performed. That is, switching from a process of changing the output of the development bias Vb based on the development correction data table to a process of maintaining the output of the development bias Vb in the fixed central value is performed. Thereafter, after decreasing the charging bias Vc from the central value to zero, the controller 190 decreases the development bias Vb from the central value to zero at a timing after tc sec (after ¼ cycle) from the decrease.

Figure 31:
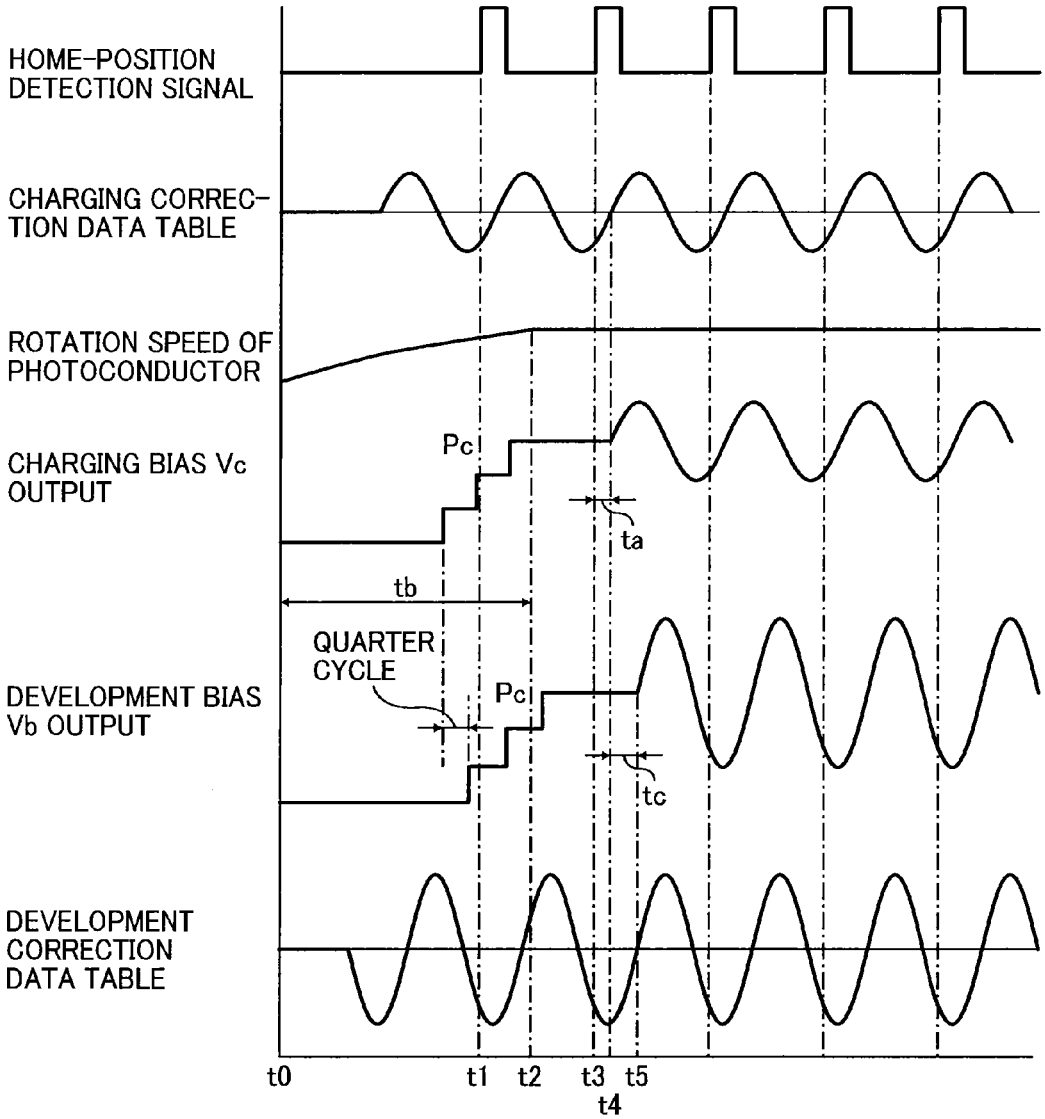
FIG. 31 is a graph of time-dependent changes of the charging bias Vc and the development bias Vb at the initiation of a print job in a comparative example of the copier according to the example.

Also, even when the charging bias Vc suddenly rises up from zero to a desired value at the initiation of the print job, the rise of the charging potential of the surface of the photoconductor may not be rapidly responsive thereto and the charging potential may be delayed to a certain extent and raised. When there is such a response delay of the charging potential, there is a possibility of a potential difference between the development bias on the assumption that there is no response delay and the charging potential of the photoconductor in which the potential is not sufficiently increased increasing in the development area. Therefore, as illustrated in FIG. 31, the charging bias Vc may rise up from zero step by step in a period before a time point t4. In this case, it is desirable to increase the development bias step by step as illustrated so that a stepwise increase of the charging potential of the photoconductor by the stepwise rise of the charging bias Vc and the stepwise increase of the development bias are synchronized in the development area. In further detail, in this copier, ¼ of the photoconductor rotation cycle is required in movement of the photoconductor surface from a contact position with the charging roller to the development area. Thus, the stepwise rise of the development bias starts at a timing after ¼ cycle from the start of the stepwise rise of the charging bias. It is possible to avoid an abnormal increase of a potential difference between the photoconductor and the development sleeve in the development area due to the response delay of charging of the photoconductor by increasing the charging bias or the development bias step by step in this manner.

Next, a copier of an example in which more characteristic configurations are added to the copier according to the embodiment will be described. Also, unless mentioned specifically hereinafter, the configuration of the copier according to the example is similar to the embodiment.

First Example

The controller 190 of the copier according to the first example causes a fluctuation waveform to appear from a position of a "second predetermined value" in which a difference from a central value is less than or equal to a predetermined threshold value without causing the fluctuation waveform to appear from a position of a central value in an area for one cycle in the fluctuation waveform when starting the periodic fluctuation of the charging bias Vc. Thereby, after a home position detection timing, it is possible to start the periodic fluctuation of the charging bias Vc in an earlier stage than when waiting for a timing corresponding to the central value of the fluctuation waveform. However, if the charging bias Vc which is the central value so far suddenly moves up/down, there is a possibility of slight background staining or carrier adherence being generated even with a slight difference. Thus, the charging bias Vc starts to gradually vary to a "second predetermined value" step by step at a home position detection timing which is a point in time slightly previous to a timing (hereinafter referred to as a "second timing") at which the fluctuation waveform of the charging bias Vc is set to the "second predetermined value." Then, the periodic fluctuation of the charging bias Vc is started at the "second timing." Thereby, it is possible to suppress the occurrence of background staining or carrier adherence.

Second Example

Rotation-angular-position detectors 180Y, 180M, 180C, and 180K configured to detect that a predetermined rotation angular position has been reached for each of the photoconductors 20Y, 20M, 20C, and 20K for Y, M, C, and K do not perform an output operation for any reason. Then, it is made impossible to correctly grasp the rotation angular position of the photoconductors 20Y, 20M, 20C, and 20K. In spite of this, when control of output fluctuation of the development bias Vb or the charging bias Vc continues depending on only a simple cycle in spite of the fact that it is difficult to accurately identify the rotation angular positions of the photoconductors 20Y, 20M, 20C, and 20K, the phases of the fluctuation waveforms may be significantly shifted from an appropriate phase and the image density unevenness may be conversely deteriorated.

Therefore, when the home-position detection signal from the rotation-angular-position detector 180 is not received across a predetermined period during rotational driving of the photoconductor 20 for each of colors of Y, M, C, and K, the controller 190 is configured to perform the following process. That is, first, a process of uniformly maintaining the output of the charging bias Vc in the central value of the fluctuation waveform is performed in place of a process of changing the output of the charging bias Vc based on the charging correction data table. In this case, at a timing (hereinafter referred to as a "first switching timing") at which the central value of the fluctuation waveform of the charging bias Vc has been caused to appear, switching from a process of periodically changing the output to a process of constantly maintaining the output in the central value is performed. Thereby, the occurrence of background staining or carrier adherence due to sudden and sharp variation of a value of the charging bias Vc is suppressed.

Next, at a timing at which a predetermined time tc has elapsed from the "first switching timing," the controller 190 performs switching from a process of changing the output of the development bias Vb based on the development correction data table to a process of constantly maintaining the output of the development bias Vb in the central value of the fluctuation waveform. A predetermined time tc is a time required from a state in which a photoconductor position charged in the central value of the charging bias Vc at the "first switching timing" opposes the charging device 60 at the "first switching timing" to a state in which the photoconductor position has entered the development area. Consequently, a timing at which a predetermined time tc has elapsed from the "first switching timing" is a timing at which the central value of the fluctuation waveform of the development bias Vb is caused to appear. It is possible to suppress the occurrence of background staining or carrier adherence due to sudden and sharp variation of a value of the development bias Vb by switching the development bias Vb to the central value from the fluctuation waveform at this timing.

Content described above is an example, and at least one embodiment of the present disclosure has a specific advantageous effect for each following aspect.

[Aspect A]

According to aspect A, there is provided an image forming apparatus including a latent-image bearing body (for example, the photoconductor 20) to be rotationally driven, a charging unit (for example, the charging device 60) to uniformly charge a surface of the latent-image bearing body, a latent-image writing unit (for example, the laser writing device 21) to write a latent image to the surface after uniform charging, a development unit (for example, the development device 61) to develop the latent image to form a toner image, a development power source (for example, the development power source 182) to output a development bias to be supplied to the development unit, and a bias control unit (for example, the controller 190) to perform a process of changing an output of the development bias from the development power source based on development bias control data so that a periodic fluctuation waveform is obtained, wherein, after the bias control unit performs a process of constantly maintaining the output of the development bias at a central value of a peak-to-peak amplitude of the fluctuation waveform after a start of an image forming operation, the bias control unit is configured to perform switching from a process of constantly maintaining the output of the development bias at the central value to the process of periodically changing the output of the development bias based on the development bias control data at a timing at which a difference from the central value in an area for one cycle in the fluctuation waveform turns to be less than or equal to a predetermined threshold value.

[Aspect B]

According to aspect B, there is provided an image forming apparatus including a latent-image bearing body to be rotationally driven, a charging unit to uniformly charge a surface of the latent-image bearing body, a latent-image writing unit to write a latent image to the surface after the charging unit uniformly charges the surface, a development unit to develop the latent image to form a toner image, a charging power-source to output a charging bias to be supplied to the charging unit, and a bias control unit to perform a process of changing an output of the charging bias from the charging power-source based on charging-bias control data so that a periodic fluctuation waveform is obtained, wherein, after the bias control unit performs a process of constantly maintaining the output of the charging bias at a central value of a peak-to-peak amplitude of the fluctuation waveform after a start of an image forming operation, the bias control unit is configured to perform switching from a process of constantly maintaining the output of the charging bias at the central value to the process of periodically changing the output of the charging bias based on the charging-bias control data at a timing at which a difference from the central value in an area for one cycle in the fluctuation waveform is less than or equal to a predetermined threshold value.

[Aspect C]

According to aspect C, in the image forming apparatus of the aspect A, a charging power-source to output a charging bias to be supplied to the charging unit is provided, and the bias control unit performs a process of changing the output of the charging bias from the charging power source based on charging bias control data so that a periodic fluctuation waveform is obtained. After the bias control unit performs a process of constantly maintaining the output of the charging bias at a central value of a peak-to-peak amplitude of the fluctuation waveform after the start of the image forming operation, the bias control unit is configured to perform switching from the process of constantly maintaining the output of the charging bias at the central value to the process of periodically changing the output of the charging bias based on the charging-bias control data at a timing at which a difference from the central value in an area for one cycle in the fluctuation waveform turns to be less than or equal to a predetermined threshold value.

[Aspect D]

According to aspect D, in the aspect C, a rotation-position detector (for example, the rotation-angular-position detector 180) to detect that the latent-image bearing body has taken a predetermined rotation angular position is provided. Based on a fluctuation waveform of the development bias or the charging bias and a position detection timing (for example, a home position detection timing) which is a timing at which the rotation-position detector has detected that the latent-image bearing body has taken the rotation angular position, the bias control unit determines a timing at which the bias control unit performs the switching from the process of constantly maintaining the output of the charging bias or the development bias to the process of periodically changing the output of the charging bias or the development bias based on the charging-bias control data or the development-bias control data.

[Aspect E]

According to aspect E, in the aspect D, the bias control unit is configured to start a process of changing the output of the development bias based on the development bias control data after changing the output of the development bias step by step from the central value to a predetermined value in which the difference from the central value is less than or equal to the threshold value.

[Aspect F]

According to the aspect F, in the aspect D or E, the bias control unit is configured to start a process of changing the output of the charging bias based on the charging-bias control data after changing the output of the charging bias step by step from the central value to a predetermined value in which the difference from the central value is less than or equal to a threshold value.

[Aspect G]

According to aspect C, in the aspect D, the bias control unit is configured to perform the switching from the process of constantly maintaining the output of the development bias at the central value to the process of periodically changing the output of the development bias based on the development bias control data at a timing at which a difference from the central value becomes zero in an area for one cycle in the fluctuation waveform of the development bias.

[Aspect H]

According to aspect H, in the aspect D or G, the bias control unit is configured to perform the switching from the process of constantly maintaining the output of the charging bias at the central value to the process of periodically changing the output of the charging bias based on the charging-bias control data at a timing at which a difference from the central value becomes zero in an area for one cycle in the fluctuation waveform of the charging bias.

[Aspect I]

According to aspect I, in any one of the aspects D to H, the image forming apparatus includes an image-density detector (for example, the optical sensor unit 150) to detect an image density of a toner image on the latent-image bearing body or a toner image transferred from the latent-image bearing body to a transfer body and a control-data construction unit (for example, the controller 190) to construct the development bias control data (for example, the development correction data table) based on a detection result of image density fluctuation of a solid toner image in a surface movement direction of the latent-image bearing body detected by the image-density detector, after a process of forming the solid toner image for image density detection on the latent-image bearing body is started based on the position detection timing.

[Aspect J]

According to aspect J, in the aspect I, the control-data construction unit is configured to perform a process of constructing the charging-bias control data (for example, the charging correction data table) based on a detection result of image density fluctuation in a halftone toner image in the surface movement direction of the latent-image bearing body detected by the image-density detector, after a process of forming the halftone toner image for image density fluctuation detection on the latent-image bearing body is started based on the position detection timing in a state in which the output of the development bias is changed based on the development bias control data.

[Aspect K]

According to aspect K, in the aspect J, the bias control unit is configured to perform the switching from the process of constantly maintaining the output of the development bias at the central value to the process of periodically changing the output of the development bias based on the development bias control data at a timing at which a leading edge of a portion charged in the process of changing the charging bias based on the charging-bias control data in an overall area in the surface movement direction of the latent-image bearing body enters a development area at which the latent-image bearing body opposes the development unit, after the switching from the process of constantly maintaining the output of the charging bias at the central value to the process of periodically changing the output of the charging bias based on the charging-bias control data is performed based on the position detection timing after the start of the image forming operation.

[Aspect L]

According to the aspect L, in the aspect K, the bias control unit is configured to perform a process of determining a timing at which switching from the process of constantly maintaining the output of the charging bias at the central value of the fluctuation waveform to the process of changing the output of the charging bias based on the charging-bias control data is performed based on the position detection timing immediately after a time necessary for a rotation speed of the latent-image bearing body to be increased to a predetermined speed has elapsed after a start of rotational driving of the latent-image bearing body.

[Aspect M]

According to the aspect M, in any one of the aspects I to L, the bias control unit is configured to perform a process of outputting the development bias at a fixed value in place of changing the output of the development bias based on the development bias control data when the peak-to-peak amplitude in the fluctuation waveform of the development bias is less than or equal to a predetermined value.

[Aspect N]

According to the aspect N, in any one of the aspects I to M, the bias control unit is configured to perform a process of outputting the charging bias at a fixed value in place of changing the output of the charging bias according to the fluctuation waveform when the peak-to-peak amplitude in the fluctuation waveform of the charging bias is less than or equal to a predetermined value.

[Aspect O]

According to the aspect O, in any one of the aspects I to N, the control-data construction unit is configured to perform a process of forming the solid toner image of a length of two or more rounds of the latent-image bearing body in the surface movement direction of the latent-image bearing body or forming a plurality of solid toner images, each of which has a length of one or more rounds of the latent-image bearing body, on the latent-image bearing body in rounds different from each other, and constructing a plurality of fluctuation waveforms separately corresponding to rounds different from each other in the latent-image bearing body based on the detection result as the fluctuation waveform of the development bias, and the bias control unit is configured to perform a process of outputting the development bias at a fixed value in place of changing the output of the development bias based on the development bias control data when a phase shift exceeding a threshold value occurs in the plurality of fluctuation waveforms.

[Aspect P]

According to the aspect P, in any one of the aspects I to O, the control-data construction unit is configured to perform a process of forming the halftone toner image of a length of two or more rounds of the latent-image bearing body in the surface movement direction of the latent-image bearing body or forming a plurality of halftone toner images, each of which has a length of one or more rounds of the latent-image bearing body, on the latent-image bearing body in rounds different from each other, and constructing a plurality of fluctuation waveforms separately corresponding to rounds different from each other in the latent-image bearing body based on the detection result as the fluctuation waveform of the charging bias, and the bias control unit is configured to perform a process of outputting the charging bias at a fixed value in place of changing the output of the charging bias based on the charging-bias control data when a phase shift exceeding a threshold value occurs in the plurality of fluctuation waveforms.

[Aspect Q]

According to the aspect Q, in any one of the aspects D to P, the bias control unit is configured to perform the process of constantly maintaining the output of the charging bias at the central value in place of the process of changing the output of the charging bias based on the charging-bias control data.

[Aspect R]

According to the aspect R, in the aspect Q, the bias control unit is configured to perform switching from the process of changing the output of the charging bias based on the charging-bias control data to the process of constantly maintaining the output of the charging bias in the central value at a timing at which the difference of the charging bias is less than or equal to the threshold value.

[Aspect S]

According to the aspect S, in the aspect R, the bias control unit is configured to perform a process of constantly maintaining the output of the development bias at the central value in place of the process of changing the output of the development bias based on the charging-bias control data when a detection signal sent from the rotation-position detector is not received across a predetermined period during rotational driving of the latent-image bearing body.

[Aspect T]

According to the aspect T, in the aspect R, the bias control unit is configured to perform switching from the process of changing the output of the development bias based on the development bias control data to the process of constantly maintaining the output of the development bias at the central value at the timing at which the difference of the development bias from the central value is less than or equal to the threshold value.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a latent-image bearing body to be rotationally driven;

a charging unit to uniformly charge a surface of the latent-image bearing body;

a latent-image writing unit to write a latent image to the surface after the charging unit uniformly charges the surface;

a development unit to develop the latent image to form a toner image;

a development power source to output a development bias to be supplied to the development unit, and a bias control unit to perform a process of periodically changing an output of the development bias from the development power source based on development bias control data, wherein, after a start of an image forming operation, the bias control unit performs a process of constantly maintaining the output of the development bias at an adjustment bias value for imaging with a pre-adjusted and fixed bias value, the adjustment bias value being a central value in a periodic fluctuation range of the output of the development bias, and at a timing at which a difference of the development bias from the adjustment bias value in the periodic fluctuation range is less than or equal to a predetermined threshold value, the bias control unit performs switching from the process of constantly maintaining the output of the development bias at the adjustment bias value to the process of periodically changing the output of the development bias based on the development bias control data.

2. An image forming apparatus, comprising:

a latent-image bearing body to be rotationally driven;

a charging unit to uniformly charge a surface of the latent-image bearing body;

a latent-image writing unit to write a latent image to the surface after the charging unit uniformly charges the surface;

a development unit to develop the latent image to form a toner image;

a charging power source to output a charging bias to be supplied to the charging unit, and a bias control unit to perform a process of periodically changing an output of the charging bias from the charging power source based on charging-bias control data, wherein, after a start of an image forming operation, the bias control unit performs a process of constantly maintaining the output of the charging bias at an adjustment bias value for imaging with a pre-adjusted and fixed bias value, the adjustment bias value being a central value in a periodic fluctuation range of the output of the charging bias, and at a timing at which a difference of the charging bias from the adjustment bias value in the periodic fluctuation range is less than or equal to a predetermined threshold value, the bias control unit performs switching from the process of constantly maintaining the output of the charging bias at the adjustment bias value to the process of periodically changing the output of the charging bias based on the charging-bias control data.

3. The image forming apparatus according to claim 2, further comprising a development power source to output a development bias to be supplied to the development unit, wherein the bias control unit performs a process of periodically changing an output of the development bias from the development power source based on development bias control data, and wherein after a start of an image forming operation, the bias control unit performs a process of constantly maintaining the output of the development bias at an adjustment bias value for imaging with a pre-adjusted and fixed bias value, the adjustment bias value being a central value in a periodic fluctuation range of the output of the development bias and performs switching from the process of constantly maintaining the output of the development bias at the adjustment bias value to the process of periodically changing the output of the development bias based on the development bias control data.

4. The image forming apparatus according to claim 3, further comprising a rotation-position detector to detect that the latent-image bearing body has taken a predetermined rotation angular position, and wherein, based on the charging-bias control data or the development bias control data, and a position detection timing at which the rotation-position detector has detected that the latent-image bearing body has taken the predetermined rotation angular position, the bias control unit determines a timing at which the bias control unit performs the switching from the process of constantly maintaining the output of the charging bias or the development bias to the process of periodically changing the output of the charging bias or the development bias based on the charging-bias control data or the development bias control data.

5. The image forming apparatus according to claim 4, wherein the bias control unit performs a process of changing the output of the charging bias from zero to the adjustment bias value of the periodic fluctuation range step by step.

6. The image forming apparatus according to claim 4, wherein the bias control unit performs a process of changing the output of the development bias from zero to the adjustment bias value of the periodic fluctuation range step by step.

7. The image forming apparatus according to claim 4, wherein, at a timing at which the difference of the charging bias from the adjustment bias value becomes zero in the periodic fluctuation range of the output of the charging bias, the bias control unit performs the switching from the process of constantly maintaining the output of the charging bias at the adjustment bias value to the process of periodically changing the output of the charging bias based on the charging-bias control data.

8. The image forming apparatus according to claim 4, wherein, at a timing at which a difference of the development bias from the adjustment bias value becomes zero in the periodic fluctuation range of the output of the development bias, the bias control unit performs the switching from the process of constantly maintaining the output of the development bias at the adjustment bias value to the process of periodically changing the output of the development bias based on the development bias control data.

9. The image forming apparatus according to claim 4, further comprising:

an image-density detector to detect an image density of a toner image on the latent-image bearing body or a toner image transferred from the latent-image bearing body to a transfer body; and a control-data construction unit to, after a start of a process of forming a solid toner image for image density detection on the latent-image bearing body based on the position detection timing, construct the development bias control data based on a detection result of image density fluctuation in the solid toner image in a surface movement direction of the latent-image bearing body detected by the image-density detector.

10. The image forming apparatus according to claim 9, wherein, after a start of a process of forming a halftone toner image for image density fluctuation detection on the latent-image bearing body based on the position detection timing in a state in which the output of the development bias is changed based on the development bias control data, the control-data construction unit performs a process of constructing the charging-bias control data based on a detection result of image density fluctuation in the halftone toner image in the surface movement direction of the latent-image bearing body detected by the image-density detector.

11. The image forming apparatus according to claim 10, wherein, after the switching from the process of constantly maintaining the output of the charging bias at the adjustment bias value to the process of periodically changing the output of the charging bias based on the charging-bias control data is performed based on the position detection timing after the start of the image forming operation, the bias control unit performs the switching from the process of constantly maintaining the output of the development bias at the adjustment bias value to the process of periodically changing the output of the development bias based on the development bias control data at a timing at which a leading edge of a portion of the latent-image bearing body charged in the process of periodically changing the output of the charging bias based on the charging-bias control data in an overall area in the surface movement direction of the latent-image bearing body enters a development area at which the latent-image bearing body opposes the development unit.

12. The image forming apparatus according to claim 11, wherein, based on the position detection timing immediately after a time necessary for a rotation speed of the latent-image bearing body to be increased to a predetermined speed has elapsed after a start of rotational driving of the latent-image bearing body, the bias control unit performs a process of determining a timing at which the bias control unit performs switching from the process of constantly maintaining the output of the charging bias at the adjustment bias value to the process of changing the output of the charging bias based on the charging-bias control data.

13. The image forming apparatus according to claim 9, wherein the bias control unit performs a process of outputting the development bias at a fixed value in place of changing the output of the development bias based on the development bias control data when the periodic fluctuation range of the output of the development bias is less than or equal to a predetermined fluctuation width.

14. The image forming apparatus according to claim 9, wherein the bias control unit performs a process of outputting the charging bias at a fixed value in place of changing the output of the charging bias based on the charging-bias control data when the periodic fluctuation range of the charging bias is less than or equal to a predetermined fluctuation width.

15. The image forming apparatus according to claim 9, wherein the control-data construction unit performs a process of forming the solid toner image of a length of two or more rounds of the latent-image bearing body in the surface movement direction of the latent-image bearing body or forming a plurality of solid toner images, each of which has a length of one or more rounds of the latent-image bearing body, on the latent-image bearing body in rounds different from each other, and constructing the development bias control data based on a result obtained by analyzing a plurality of image density fluctuation waveforms separately corresponding to rounds different from each other in the latent-image bearing body, and wherein the bias control unit performs a process of outputting the development bias at a fixed value in place of changing the output of the development bias based on the development bias control data when a phase shift exceeding a threshold value occurs in the plurality of image density fluctuation waveforms.

16. The image forming apparatus according to claim 9, wherein the control-data construction unit performs a process of forming a halftone toner image of a length of two or more rounds of the latent-image bearing body in the surface movement direction of the latent-image bearing body or forming a plurality of halftone toner images, each of which has a length of one or more rounds of the latent-image bearing body, on the latent-image bearing body in rounds different from each other, and constructing the charging-bias control data based on a result obtained by analyzing a plurality of image density fluctuation waveforms separately corresponding to rounds different from each other in the latent-image bearing body, and wherein the bias control unit performs a process of outputting the charging bias at a fixed value in place of changing the output of the charging bias based on the charging-bias control data when a phase shift exceeding a threshold value occurs in the plurality of mage density fluctuation waveforms.

17. The image forming apparatus according to claim 4, wherein the bias control unit performs the process of constantly maintaining the output of the charging bias at the adjustment bias value in place of the process of changing the output of the charging bias based on the charging-bias control data when a detection signal sent from the rotation-position detector is not received across a predetermined period during rotational driving of the latent-image bearing body.

18. The image forming apparatus according to claim 17, wherein the bias control unit performs switching from the process of changing the output of the charging bias based on the charging-bias control data to the process of constantly maintaining the output of the charging bias at the adjustment bias value at a timing at which the difference of the charging bias from the adjustment bias value is less than or equal to the predetermined threshold value.

19. The image forming apparatus according to claim 18, wherein the bias control unit performs a process of constantly maintaining the output of the development bias at the adjustment bias value in place of the process of changing the output of the development bias based on the development bias control data when the detection signal sent from the rotation-position detector is not received across the predetermined period during the rotational driving of the latent-image bearing body.

20. The image forming apparatus according to claim 19, wherein the bias control unit performs the switching from the process of changing the output of the development bias based on the development bias control data to the process of constantly maintaining the output of the development bias at the adjustment bias value at the timing at which a difference of the development bias from the adjustment bias value is less than or equal to a threshold value.

* * * * *